US005858942A

United States Patent [19]

Adams et al.

[11] Patent Number: 5,858,942

[45] Date of Patent: Jan. 12, 1999

[54] ENGINE CLEANER COMPOSITION, METHOD AND APPARATUS WITH ACETONITRILE

[76] Inventors: Lawrence J. Adams, 971 Spinnakers Reach Dr., Ponte Vedra Beach, Fla. 32082; Paul D. Hughett, 4540 Carolyn Cove, Jacksonville, Fla. 32258

[21] Appl. No.: 737,097

[22] PCT Filed: Apr. 14, 1995

[86] PCT No.: PCT/US95/04674

§ 371 Date: Oct. 24, 1996

§ 102(e) Date: Oct. 24, 1996

[87] PCT Pub. No.: WO95/28236

PCT Pub. Date: Oct. 26, 1995

Related U.S. Application Data

[63] Continuation-in-part of Ser. No. 227,795, Apr. 14, 1994, abandoned.

[51] Int. Cl.[6] ..... B08B 9/00; C11D 7/32; C11D 7/50; F02B 77/04

[52] U.S. Cl. ..... 510/185; 510/184; 510/187; 510/245; 510/262; 510/365; 134/20; 134/22.12; 134/22.14; 134/39; 134/167 R; 123/1 A; 123/198 A

[58] Field of Search ..... 252/153, 171, 252/542; 134/20, 22.12, 22.14, 39, 167 R; 123/1 A, 198 A; 510/185, 184, 187, 245, 262, 365

[56] References Cited

U.S. PATENT DOCUMENTS

| | | | |
|---|---|---|---|
| 4,407,741 | 10/1983 | Maggi | 252/542 |
| 4,746,420 | 5/1988 | Darian et al. | 208/222 |
| 4,780,235 | 10/1988 | Jackson | 252/170 |
| 4,784,170 | 11/1988 | Romanelli et al. | 134/113 |
| 4,807,578 | 2/1989 | Adams et al. | 123/198 A |
| 4,920,996 | 5/1990 | Flanner | 134/22.11 |
| 4,989,561 | 2/1991 | Hein et al. | 123/198 A |
| 4,992,187 | 2/1991 | Adams et al. | 252/50 |
| 5,264,158 | 11/1993 | Stern | 252/525 |
| 5,340,488 | 8/1994 | Adams et al. | 252/47.5 |
| 5,401,325 | 3/1995 | Mihelic et al. | 134/39 |
| 5,401,326 | 3/1995 | Mihelic et al. | 134/40 |
| 5,612,303 | 3/1997 | Takayanagi et al. | 510/174 |

FOREIGN PATENT DOCUMENTS

| | | |
|---|---|---|
| 1669925 | 8/1991 | U.S.S.R. . |

*Primary Examiner*—Douglas J. McGinty
*Attorney, Agent, or Firm*—Lieberman & Nowak, LLP

[57] ABSTRACT

An engine cleaner composition and method for removing carbonaceous deposits from engine fuel-system components such as mechanical and electronic fuel injectors, intake valve seats, valves, combustion cylinders, spark plugs, and oxygen sensors may be used on both gasoline and diesel engines. Preferred compositions comprise a synergistic solution of a heterocyclic ring compound in an azeotrope of acetonitrile and water, together with selected surfactants and aromatics. Preferred compositions of the invention may be placed in an aerosol pressurized unit utilizing a compressed gas, such as nitrogen or nitrous oxide, or compressed liquid gas, such as a hydrocarbon or fluorohydrocarbon. Preferred engine cleaning compositions of the invention are substantially non-ozone depleting, are low in global warming, and have a low order of human toxicity. Preferred compositions have a moderate pH and are essentially compatible with metals and elastomers conventionally used in engine fuel-system components. The invention provides a consumer or a professional engine mechanic with a safe, easy and efficient way to clean engine fuel-system components.

37 Claims, 17 Drawing Sheets

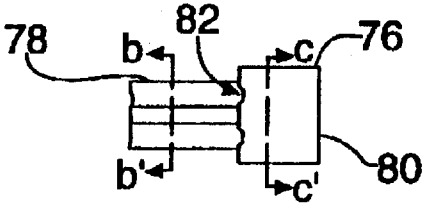
FIG. 17a
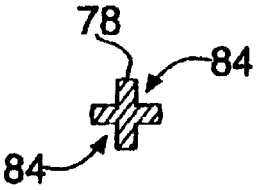
FIG. 17b
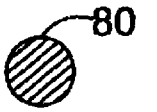
FIG. 17c
FIG. 18a
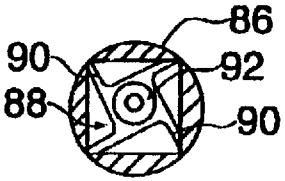
FIG. 18b
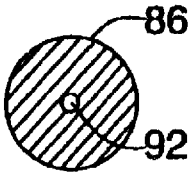
FIG. 18c

ENGINE CLEANER COMPOSITION, METHOD AND APPARATUS WITH ACETONITRILE

RELATED APPLICATION

This application is a continuation in part of our application, Ser. No. 08/227,795, filed Apr. 14, 1994, now abandoned.

BACKGROUND ART

The efficient operation of a modern computer-controlled internal-combustion engine depends in part on the ability of the computer of the engine to control accurately the air/fuel ratio and the timing of the spark. Such accurate control requires that critical component parts of the system function at close to optimum O.E.M. values. One common hinderance to optimum operation has been the fouling of engine component parts with carbonaceous deposits.

Several years ago fouling of electronic fuel injectors in automobile engines became a serious problem. Injector cleaners were developed to give some relief to the injector fouling problem. After study of the problem by O.E.M. engineers and oil company chemists, it was concluded that possibly the most serious contributing factor to injector fouling was the presence of high levels of diolefins, sulfides and other polar compounds in gasolines. Other contributing factors included exhaust gas from exhaust-gas recirculation "EGR," positive crankcase ventilation ("PCV") gas, positioning of injectors close to the intake valves receiving hot back-soak temperatures, and location of injector spray pintles close to the outer tips of the injectors.

In answer to the problem of fuel-injector fouling, certain manufacturers of electronic fuel injectors redesigned their injectors. In addition, certain O.E.M.'s repositioned their injectors further back from the intake valves. Oil companies significantly reduced diolefins, sulfides, and other polar compounds in gasoline, and, in addition, the companies began to add alkylamine detergents to gasoline to help keep injectors clean. As a consequence, fuel injector deposit problems have been reduced significantly, although cleaning is occasionally still needed. However, deposits on other engine fuel areas remained a problem; e.g. intake valves, spark plugs, combustion chambers, and oxygen sensors.

With the passage of time, workers in the art were successful in developing several generic approaches for obviating the foregoing limitations. Briefly, these techniques included the following.

(a) A carburetor cleansing operation which involves pouring a cleaning composition directly into an open air throttle on the carburetor with the engine operating at a high rpm level. In this procedure, the cleaner employed is admixed with the fuel and the combination burned during the combustion process. As the cleaning liquid flows over the bottom of the intake runners in this operation, approximately 30% of the surfaces are cleaned.

(b) An injector cleaning process involving the use of a pressurized container having contained therein an engine fuel and a cleaning agent in a ratio of about four parts fuel to one part cleanser. The pressurized container is connected to a transfer apparatus which is then adapted to the injector fuel rail of the engine. The fuel system is the disabled and the engine operated on the fuel/cleaner mixture from the pressurized container. This technique has been found to clean the fuel injector satisfactorily but does not appear effect cleansing of the intake valves or valve seats.

(c) A vacuum disconnect technique which involves disconnecting a vacuum line on the air intake plenum and then connecting a rubber flex line to the vacuum outlet. Following, the other end of the flex line is inserted into a container of cleaning fluid. At that juncture, the engine is started and the vacuum used to evacuate the cleaning fluid from the container into the plenum. The cleaning fluid then follows the route of least resistance to the center of gravity down the plenum from the point of entry. Studies have revealed that some intake runners get the major portion of the cleaning fluid while others get none. A further limitation of this procedure arises in that the cleaning fluid does not come into contact with the injectors and therefore provides limited or no cleaning.

(d) A commercial procedure to chemically clean mechanical and electronic fuel injectors together with upper engine components wherein chemical compositions are added to the fuel tank of a vehicle, cleansing being effected as the vehicle is operated. In the operation of such process it is common to employ 100 parts of fuel to one part of cleaning fluid. Studies of such processes have revealed that the use of high levels of polybuteneamine fuel additive result in the effective cleansing of soiled injectors. However, this has not proven effective at removing hardened carbonaceous deposits in the intake valve.

The numerous problems created by the presence of excessive carbonaceous deposits on intake valves include engine power loss, acceleration problems, higher emissions and fuel combustion, so creating a need for correction thereof. Currently, this end is effected either by removing the intake valves, cleaning them and re-installing, or by removing the air intake manifold (plenum) and installing a "walnut shell blaster" which loosens the carbonaceous deposits using a high pressure force of small walnut shell chips. Each of these procedures is labor intensive and economically unattractive. Unless the vehicle in issue is still under warranty, the owner will generally wait until the vehicle fails emission tests or the engine operation deteriorates to the point where it is malfunctioning.

Accordingly, it has been found that none of the aforementioned prior art procedures has been able to provide the simultaneous cleansing of fuel system engine components such as air intake plenums, intake runners, intake valves and valve seats, oxygen sensors and catalytic converters.

U.S. Pat. No. 4,992,187 to Adams et al. disclosed a composition for cleaning an internal combustion engine which included a five-membered heterocyclic ring compound and hydrazine. Although the composition of the patent could be effective in cleaning internal combustion engines, the composition had an undesirably high order of toxicity and was expensive. The technique of the patent generally required a skilled mechanical technician to clean the mechanical or electronic fuel injectors of an engine and an especially high level of skill to clean other upper engine fuel-system components.

U.S. Pat. No. 4,807,578 disclosed an injector cleaning system and technique. The technique required a quantity of an active injector cleaner to be blended into a larger quantity of engine fuel. The resulting blend was placed into a pressure resistant container and then pressurized with a compressed gas, such as air or nitrogen. A special adapter was used to attach the pressurized container to the fuel rail of the engine to be cleaned. In general, different engine models required different adapters. Consequently, a garage using the engine cleaning technique of the '578 patent had to stock a large number of adapters, with the number of adapters growing larger with each new vehicle model.

Although the injector cleaning system of the '578 patent can be effective in cleaning fuel injectors, there are a number of drawbacks with this system in practice. For example, because the fuel/cleaner mixture in the container is pressurized, several types of failure, although rare, present the hazard of a mechanic being sprayed with the cleaner/fuel or in the cleaner/fuel being sprayed onto a hot engine or onto painted surfaces of the vehicle, all with potentially serious consequences. Such potentially serious failures can arise if the threads of the connector connecting the aerosol unit to the adapter apparatus are stripped by over tightening; or if a regulator diaphragm of the adapter apparatus ruptures; or if a fitting between the regulator and a ball valve of the adapter apparatus breaks as a result of the stress of opening and closing the ball valve over a period of time.

In addition, if the wrong adapter in the apparatus of the '578 patent is used to attach the pressurized container containing fuel and cleaner to the fuel rail of the throttle body; or if the adapter seal leaks; or if the return fuel line plug is not sufficiently secured; of if the high pressure fuel line is not reattached to the fuel rail correctly, fuel or the cleaner/fuel mixture can drip onto a hot engine.

Moreover, if the return fuel line is not clamped closed in the technique of the '578 patent, the injector cleaner can flow back to the fuel tank, which can result in damage to an electric fuel pump. If an injector-cleaner apparatus of the patent remains attached to a fuel rail overnight or over a weekend, damage can be caused to a diaphragm in the fuel-return pressure regulator.

Heretofore, the only solvents known to produce sufficient synergistic engine-cleaning activity for heterocyclic ring compounds were highly alkaline compounds, such as alkylamines, ammonia, or hydrazine. When such alkaline compounds are blended with certain heterocyclic five-membered ring compounds, the resulting blend can be irritating to the skin. As a result, use of such engine cleaners by the general public is not recommended and even use by professionals is now being questioned.

A need exists for a safe and efficient chemical composition to clean injectors, intake valves, combustion chambers, spark plugs, oxygen sensors and other fuel/combustion components of internal combustion engines which need not be injected into the high pressure side of the fuel-system fuel rail and for an engine cleaning process which is so inherently safe that persons with little or no mechanical skill can conduct the cleaning process.

It is an object of the invention to provide a composition of low toxicity capable of efficiently cleaning internal combustion engine parts which can be introduced into the engine through the air intake system. It is a further object of the invention to provide a method of cleaning internal combustion engines which can be used safely by consumers as well as skilled automobile mechanics and which is inexpensive relative to conventional engine-cleaning techniques.

It is yet a further object of the invention to provide an engine cleaning composition that has a moderate or neutral pH and which would provide the cleaning power needed for the difficult job of cleaning carbonaceous deposits from internal engine surfaces.

It is also an object of the present invention to provide an inexpensive apparatus for cleaning injectors, air intake plenums, intake valves and valve seats, combustion chambers, oxygen sensors and catalytic converters, said apparatus having a cost less than that of a high quality screwdriver.

A still further object of the present invention is to provide a vehicle owner with a safe and simple technique coupled with a low cost apparatus that has sufficient versatility to attach to the air intake plenum of any internal combustion engine.

SUMMARY OF THE INVENTION

The invention broadly concerns the discovery that certain blends of acetonitrile and water combined with certain heterocyclic ring compounds can produce a synergistic cleaning effect for surfaces in internal combustion engines subject to fouling.

The subject invention also provides an engine cleaner apparatus which includes a pressurized container which is charged with a quantity of a preferred cleaning composition of the invention or other suitable cleaning composition and a compressed liquid gas propellant, the container being capable of adapting to the air intake plenum of an internal combustion engine.

The subject invention provides an engine cleaner composition for removing varnish and burned-on sludge from surfaces in an internal combustion engine, which composition comprises (i) a ring-containing compound wherein the ring compound includes one or more rings of five or six consecutively linked atoms, and (ii) a blend of acetonitrile and water. Preferably, the acetonitrile and water in the blend are essentially in proportions to form an azeotrope. Most preferably, the relative proportions of the ring compound and the blend of acetonitrile and water are such that the cleaning action of the ring compound and the blend of acetonitrile and water are synergistically significantly increased.

The engine cleaner composition of the invention comprises a heterocyclic ring compound having a boiling point of about 250° F. or greater and a blend of X weight percent water and (100-X) weight percent acetonitrile, where X is in the range of from about 5 to about 25 weight percent based on the combined weight of the water and the acetonitrile. Preferably, X is in the range of from about 10 to about 20 weight percent based on the combined weight of the water and the acetonitrile. Most preferably, X is approximately equal to 16 weight percent so that the blend of water and acetonitrile are substantially in the proportions of a water/acetonitrile azeotrope.

Preferably, the engine cleaner composition of the invention includes two, and more preferably three heterocyclic ring compounds.

Preferably, the engine-cleaner composition of the invention also includes a surfactant. Preferably, the surfactant is isopropylamine dodecylbenzene sulfonate ("P-1059") or and polyoxylated alkyl phosphate ester ("PS 222").

The engine-cleaner composition of the invention preferably also includes an aerosol propellant. Preferred aerosol propellants are fluorohydrocarbon "134-a" and an aerosol grade hydrocarbon blend designated in the trade "A-46."

An engine-cleaner method of the invention for cleaning carbonaceous-deposits from internal surfaces of an internal combustion engine comprises the step of introducing a quantity of a preferred engine-cleaner composition of the invention or other suitable engine-cleaner composition into an air-intake manifold of the engine as an aerosol fog. The method of the invention also includes the step of allowing the engine-cleaner composition to interact with carbonaceous-deposit material on internal surfaces of the engine with the engine off for an engine-cleaner-soak time sufficient to permit a portion of the engine-cleaner composition to soak into and loosen, soften, or dissolve carbonaceous-deposit material on the internal surfaces. The engine cleaner method of the invention further includes the step of running the engine for a time to remove carbonaceous-deposit material, loosened, softened, or dissolved by the engine cleaner from internal surfaces of the engine.

Preferably, prior to the step of introducing the quantity of engine-cleaner composition into the air-intake manifold of the engine, the engine is run for a time sufficient to warm up the engine.

Preferably, the method of the invention includes the step of adding a quantity of a surfactant fuel additive to the fuel of the engine.

Preferred engine-cleaner compositions of the invention have a low order of toxicity, a moderate or neutral pH and are capable of efficiently loosening, softening, dissolving and otherwise tending to remove epoxies, varnish and burned-on sludge in an internal combustion engine. Effective engine cleaning is provided with a synergistic mixture of one or more carbonaceous-deposit-softening ring compounds having boiling points above typical engine operating temperatures of roughly 200°–220° F. and a water/acetonitrile ring-compound-cleaner activating solvent.

The following five heterocyclic ring compounds are preferred for the engine-cleaning compositions of the invention. Each of the five heterocyclic provides an advantageous combination of boiling point temperature vs. synergizable engine cleaning activity for dissolving carbonaceous engine deposits in the presence of a water/acetonitrile activating solvent.

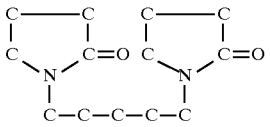

750° F.
2-methyl-1, 5-Bis (2-oxo pyrrolidin-l-y1) pentane

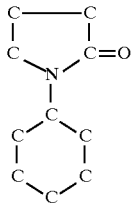

543° F.
N-cyclohexyl-2-pyrrolidone

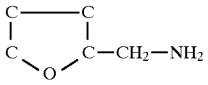

294° F.
2-furfurylamine

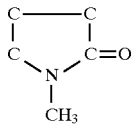

396° F.
N-methyl-2-pyrrolidone

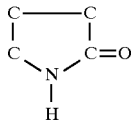

473° F.
2-pyrrolidone

The heterocyclic ring compounds listed below tend to exhibit a synergistic increase in engine cleaning activity when combined with the azeotrope of water and acetonitrile and may be suitable to include in an engine cleaner composition for certain applications, although for reasons of toxicity, cost, boiling point, or incompatibility with other components of the composition, they are generally less preferred than the preferred heterocyclic ring compounds listed above:

tetrahydrofuran
butyrolactone
N-ethyl-pyrrolidone
N-(2-hydroxyethyl)-2-pyrrolidone
N-(aminoethyl)-pyrrolidone
furfural
furan
tetrahydrofurfuryl alcohol
furfural alcohol
dibutyrolactam
N-butyl pyrrolidone
isopropyl pyrrolidone
isooctyl pyrrolidone
tetradecyl pyrrolidone
hexadecyl pyrrolidone
octadecyl pyrrolidone
octyl pyrrolidone
dodecyl pyrrolidone
cocalkyl pyrrolidone.

Other engine cleaner compositions which may be suitable in the engine cleaner process and engine cleaner apparatus of the invention in certain applications include conventional gasoline-additive engine cleaners such as the commercial gasoline-additive cleaners with the trade names "ORONITE OGA 273," available from Chevron Chemical Company of San Francisco, Calif.; "HITEC 4940," available from Ethyl Petroleum Additives, Inc. of St. Louis, Mo., "Paradyne 741/PDN 2577," available from Exxon Chemical Americas of Houston, Tex. and "LZ 8293," available from The Lubrizol Corporation of Wickliffe, Ohio. Such commercial gasoline-additive cleaner compositions may be combined with an aerosol propellant such as the propellant A-46 for use in the engine cleaner method and engine cleaner apparatus of the invention. Preferred proportions are about 30 parts by weight gasoline-additive cleaner composition and about 70 parts by weight aerosol propellant.

BRIEF DESCRIPTION OF THE FIGURES

Preferred embodiments of the invention are described below with reference to the following drawings:

FIG. 17*a* is a side view of a Maltese cross post insert which can be press fitted into the standard inside diameter channel of the plastic adapter of FIG. 16.

FIGS. 17*b* and 17*c* are cross-sectional views of the Maltese-cross insert of FIG. 17*a* taken along lines b–b' and c–c', respectively.

FIG. 18*a* is a cross-sectional side view of a swirl channel insert which can be press fitted into an insert holder socket of the plastic adapter of FIG. 16 downstream of the Maltese-cross insert of FIG. 17.

FIGS. 18*b* and 18*c* are cross-sectional views of the swirl channel insert of FIG. 18*a* taken along lines b–b' and c–c', respectively.

DETAILED DESCRIPTION OF THE INVENTION

N-cyclohexyl-2-pyrrolidone (CHP) was found to be responsive to synergistic activity in engine cleaning effectiveness of the kind discussed in U.S. Pat. No. 4,992,187. The compound CHP was used to search for evidence of synergism in engine cleaning efficiency from neutral pH solvents that were not identified as possible carcinogens by IARC, NTP, OSHA or ACGIH.

Surprisingly, the water azeotrope of acetonitrile was found to exhibit synergistic activity with respect to CHP cleaning efficiency. Both acetonitrile and water independently tested show essentially no synergistic activity. Similar compounds such as dimethyl acetamide and dimethyl formamide show essentially no synergism either independently or combined with water.

Figure 1:
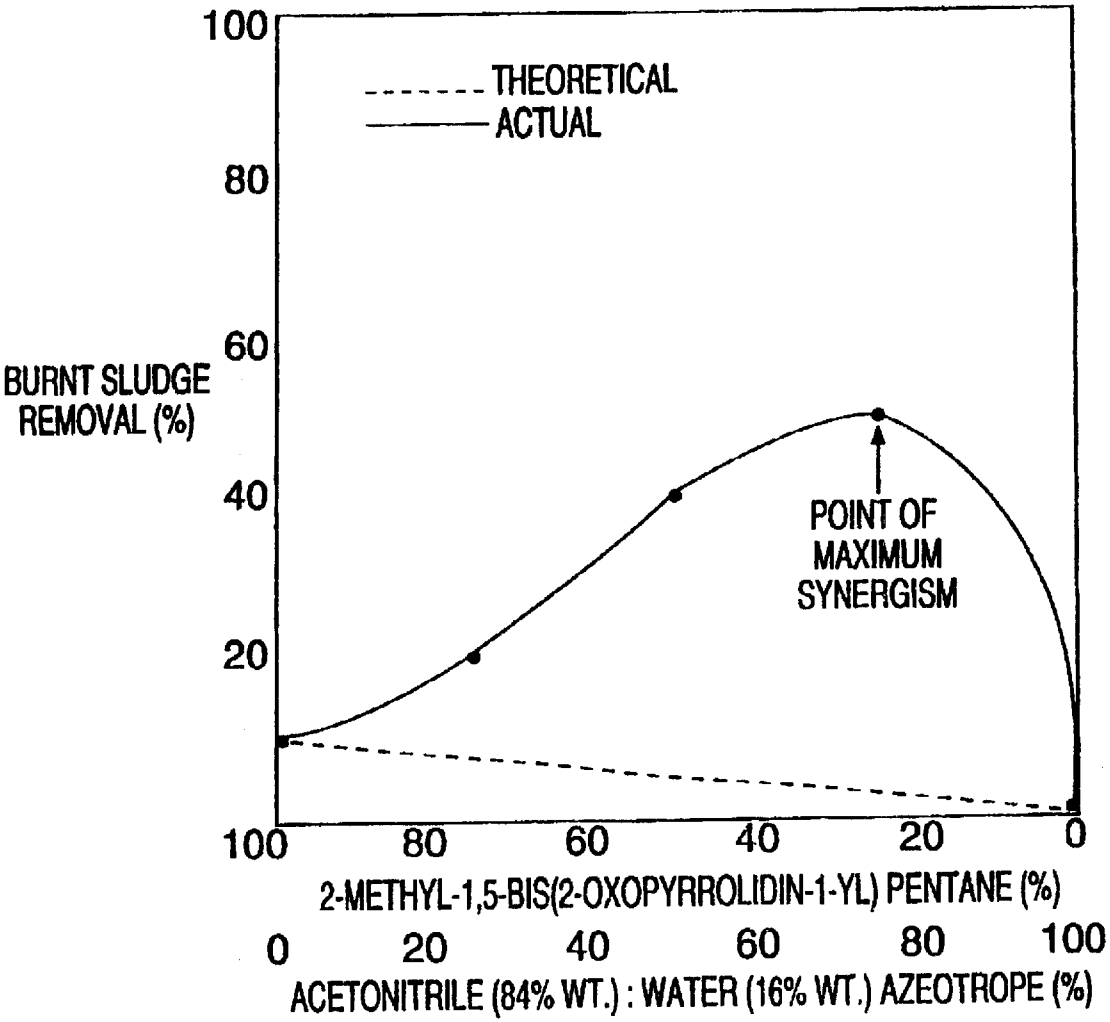
FIG. 1 is a graph showing the cleaning efficiency of 2-methyl-1,5-Bis(2-oxopyrrolidin-1-yl) pentane and an azeotrope blend of acetonitrile and water on a spark plug with a category "a" soil rating emersed for about 10 minutes at approximately 70° F.—a cleansing procedure termed the "CSPIT" test. The dashed line represents an expected theoretical curve. The solid line represents the actual experimental curve, which exhibits a synergistic increase in cleaning efficiency.
Figure 2:
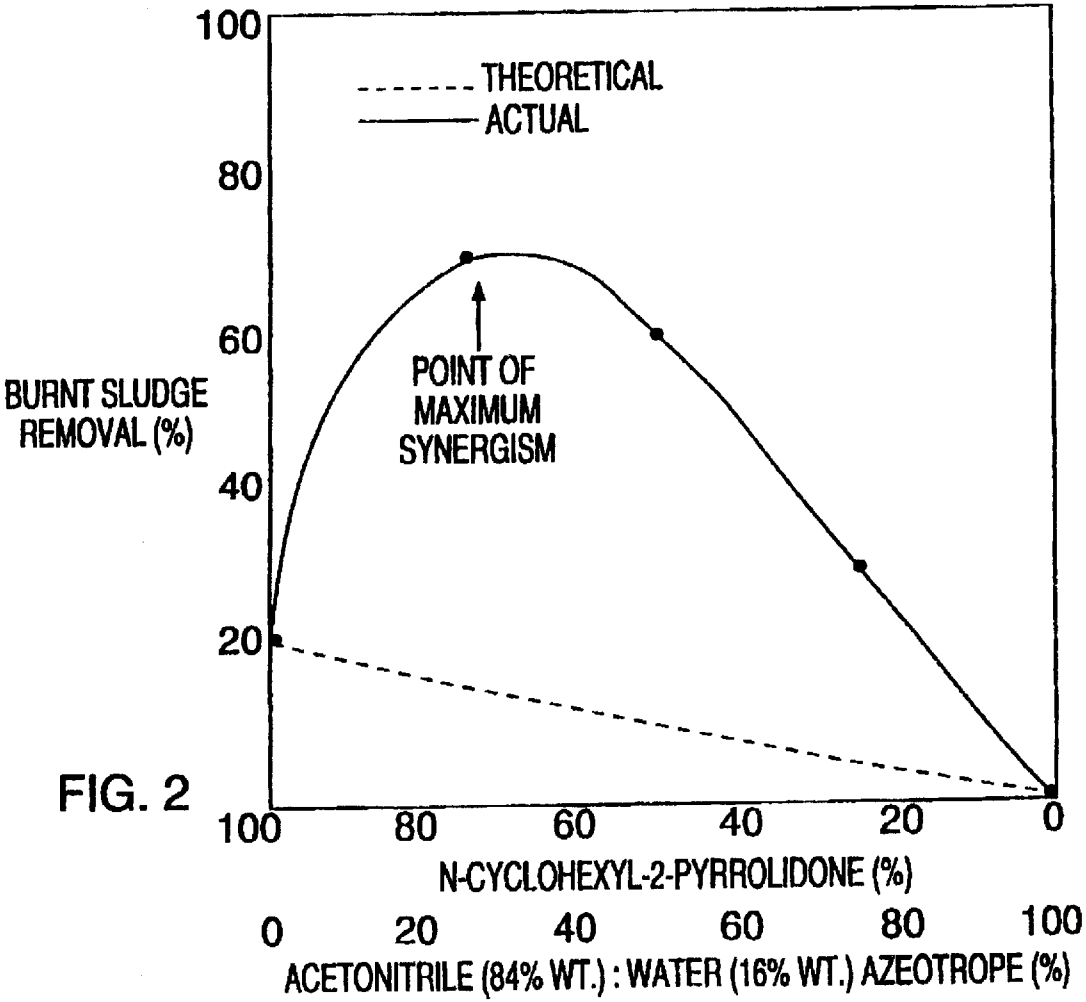
FIG. 2 is a graph showing the cleaning efficiency of N-cyclohexyl-2-pyrrolidone and the azeotrope of acetonitrile and water using the "CSPIT" cleaning procedure on a spark plug with a category "a" soil rating. The immersion time was about 10 minutes at approximately 70° F. The dashed line represents the expected theoretical curve. The solid line represents the actual experimental curve, which exhibits a synergistic increase in cleaning efficiency.
Figure 3:
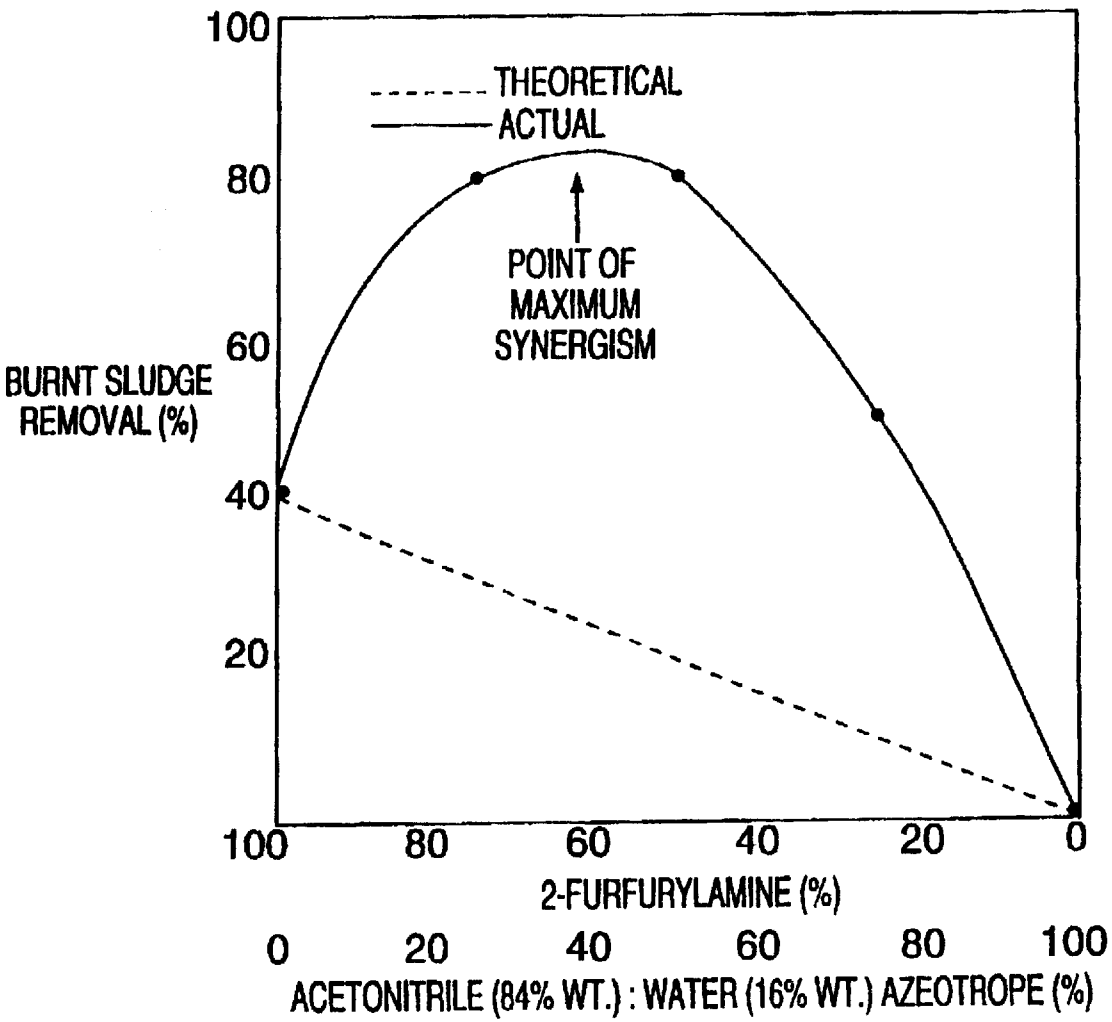
FIG. 3 is a graph showing the cleaning efficiency of 2-furfurylamine and the azeotrope of acetonitrile and water using the "CSPIT" cleaning procedure on a spark plug with a soil rating of category "a" using an approximately 10 minute immersion time at approximately 70° F. The dashed line represents the expected theoretical curve. The solid line represents the actual experimental curve which exhibits a synergistic increase in cleaning efficiency.
Figure 4:
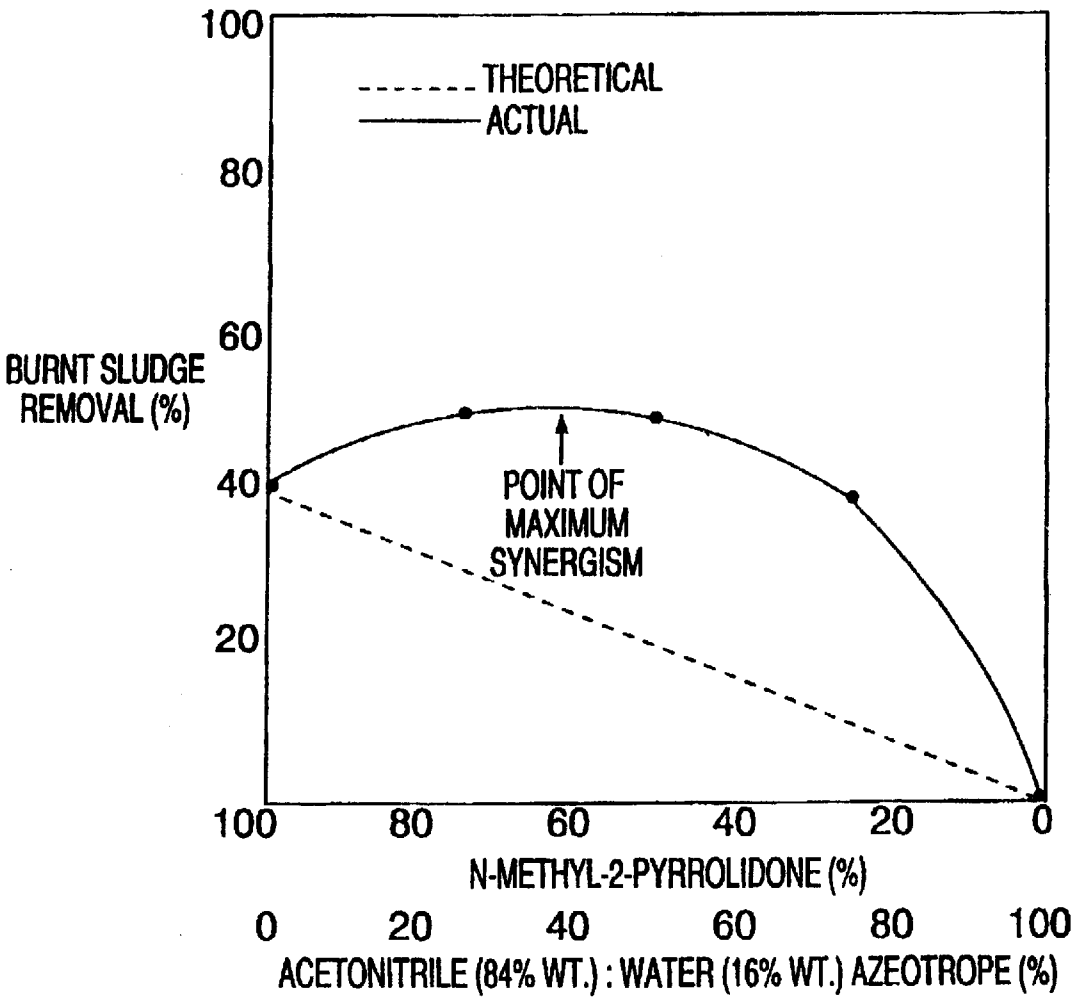
FIG. 4 is a graph showing the cleaning efficiency of N-methyl-2-pyrrolidone and the azeotrope of acetonitrile and water using the "CSPIT" cleaning procedure on a soiled spark plug with a soil rating of category "a" for about 10 minutes immersion time at approximately 70° F. The dashed line represents the expected theoretical curve and the solid line represents the actual experimental curve which exhibits a synergistic increase in cleaning efficiency over a certain concentration range.
Figure 5:
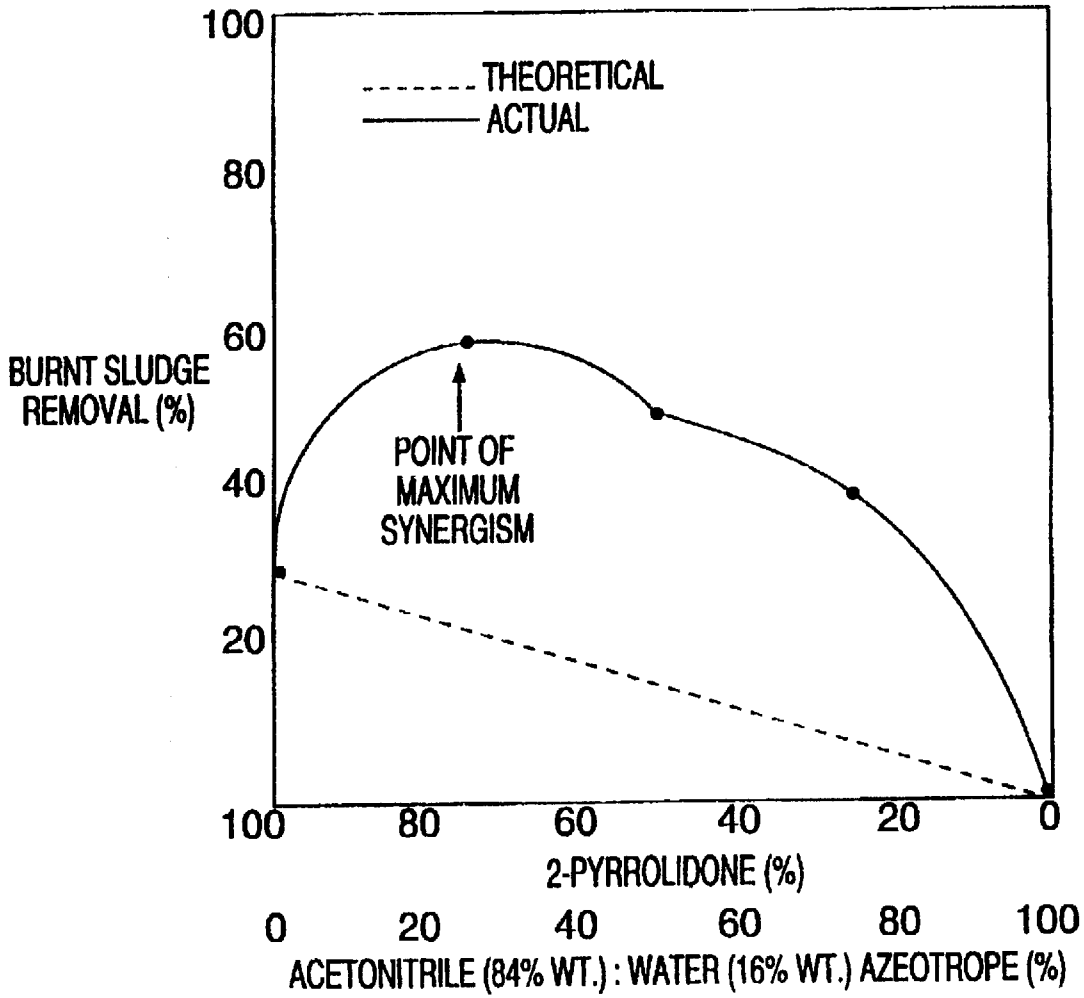
FIG. 5 is a graph showing the cleaning efficiency of 2-pyrrolidone and the azeotrope of acetonitrile and water using the "CSPIT" cleaning procedure on a soiled spark plug with a soil rating of category "a" for about 10 minutes at approximately 70° F. The dashed line represents the expected theoretical curve and the solid line represents the actual experimental curve which exhibits a synergistic increase in cleaning efficiency.
Figure 6:
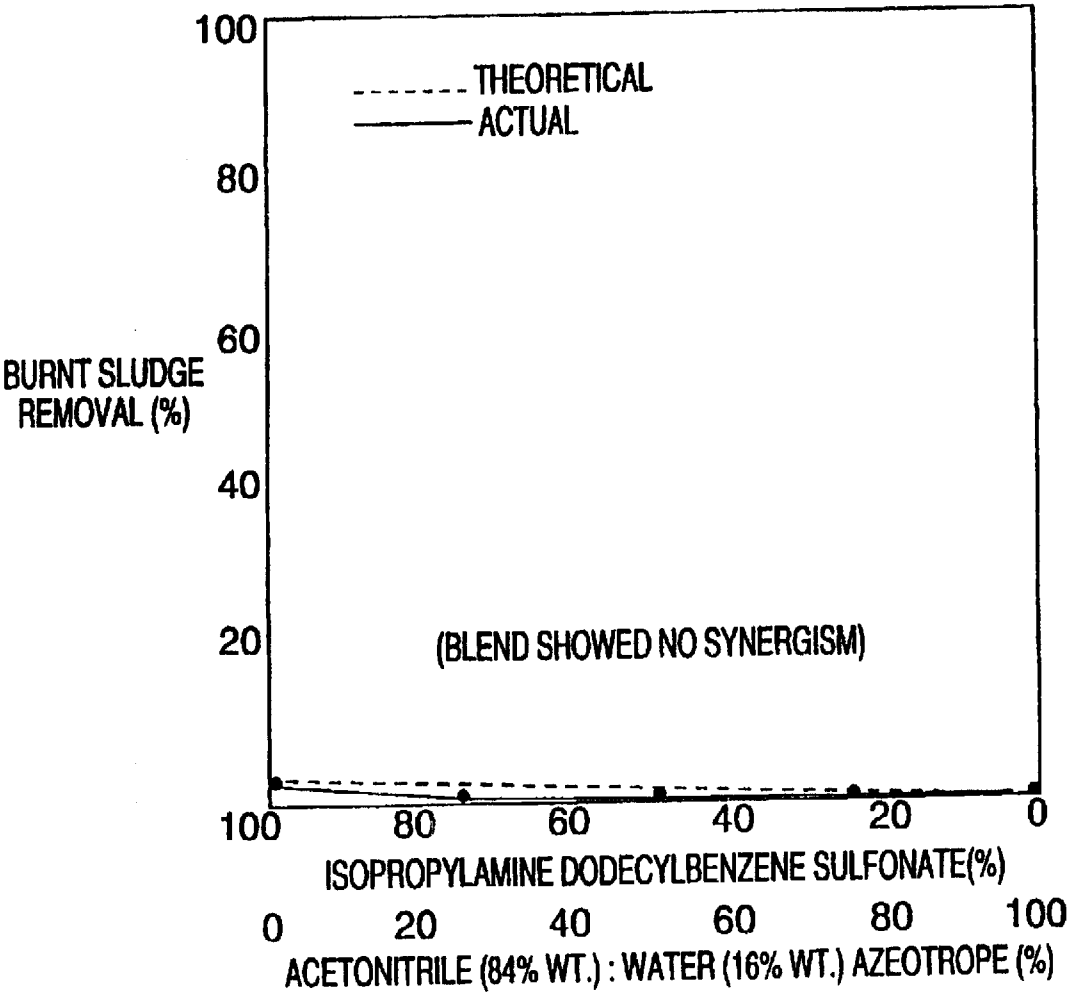
FIG. 6 is a graph showing the cleaning efficiency of isopropylamine dodecylbenzene sulfonate and the azeotrope of acetonitrile and water using the "CSPIT" cleaning procedure on a soiled spark plug with a soil rating of category "a" for about 10 minutes at approximately 70° F. The dashed and the solid lines are essentially the same. Essentially, no synergism in cleaning efficiency was found.

An appropriate theory to explain the observed synergistic increase in cleaning efficiency is not available, especially synergistic increases of the magnitude shown in FIG. 2.

Generally, more effective cleaning is obtained when soaking a fully warmed-up engine, during a time the engine back-soak temperature ranges from about 250° F. to about 350° F. Immediately after a fully warmed-up engine is turned off, some of the engine surfaces to be cleaned, e.g., the exhaust and intake valve seats, the spark plugs, the piston rings and the oxygen sensor, are at temperatures around 750° F. and generally cool down rapidly to temperatures around 300° F. for from roughly 20 to 30 minutes. Other engine surfaces to be cleaned, e.g., the intake valve tulips, the in-take valve stems, and the fuel injector tips are at temperatures around 200° F. immediately after a fully warmed-up engine is turned off and generally increase to temperatures around 300° F. in roughly 20 to roughly 30 minutes. The air throttle body is also cleaned, which generally has an average temperature around 150° F. immediately after a fully warmed-up engine is turned off.

Engine hot-soak cleaning studies showed that generally the best cleaning results were obtained using three synergized heterocyclic ring compounds. Acceptable cleaning results were obtained using combinations of two synergized heterocyclic ring compounds. When an engine cleaner composition includes a combination of three ring compounds, at least two preferably have boiling points of more than about 100° F. above the engine back-soak temperatures of approximately 300° F. When the engine cleaner composition includes only two heterocyclic ring compounds, the boiling point of one of the two is preferably about 200° F. above the engine back-soak temperature of approximately 300° F. The remaining heterocyclic ring compound in each case preferably has a boiling point about equal to the engine back-soak temperature of about 300° F.

If desired, the engine cleaner composition of the invention could be used to clean injectors and other engine parts in the manner of the composition described in U.S. Pat. No. 4,992,187, using an apparatus and adapters such as described in U.S. Pat. No. 4,807,578 to introduce the composition into the engine's high-pressure fuel-supply system. However, as noted above, the engine cleaning process of the '187 and '578 patents has given rise to some problems even when used by professionals.

Figure 8:
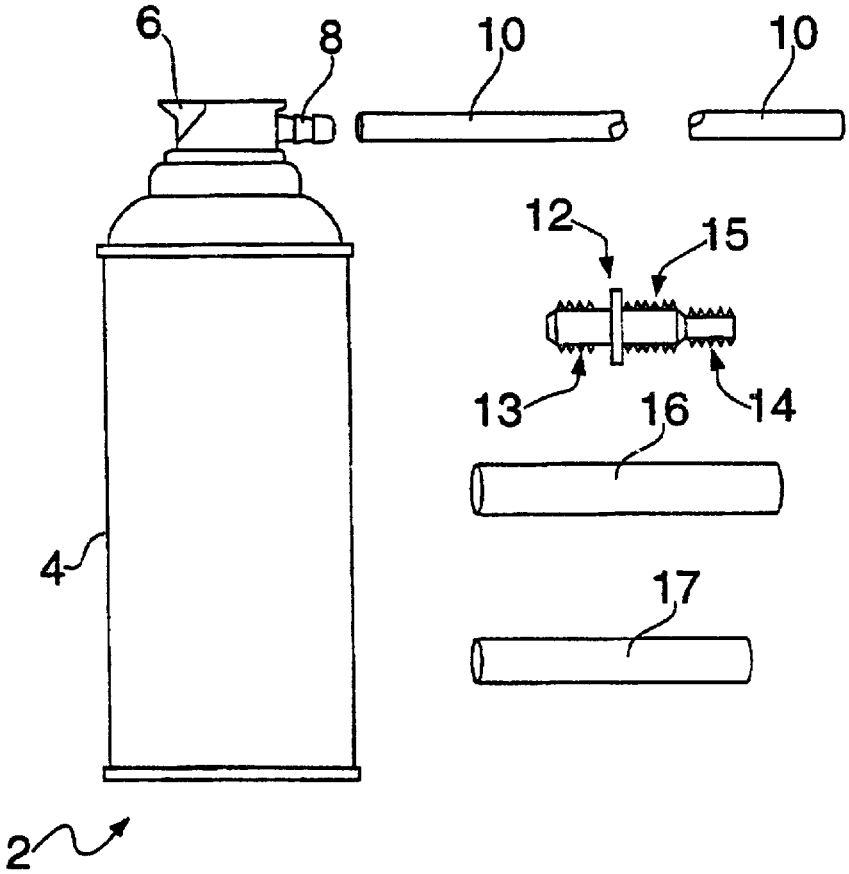
FIG. 8 is a side view of a preferred engine cleaner kit of the invention for dispensing an engine cleaner composition into an air-intake plenum of an internal combustion engine in the form of an aerosol fog.

A preferred engine cleaning method of the invention is to charge a pressure-resistant container of an aerosol engine cleaner kit with a preferred synergistic engine cleaner composition of the invention under pressure which includes an aerosol propellant liquid. Formula 61 from Table III below is particularly preferred for this application. As shown in FIG. 8, an aerosol engine cleaner kit 2 has a flexhose 10 which can be attached to an outlet fitting 8 of a push button valve 6 of a pressure-resistant aerosol container 4. The push-button valve 6 permits the pressurized contents of the container 4 to be controllably discharged through the flexhose 10. The flexhose 10 probably has an inside diameter of about 3/16 inch (4.8 mm) and a length of from about three to about seven feet (1 to 2.1 m). The flexhose 10 may be made of neoprene, Buna rubber, natural rubber, polyethylene or polyvinylchloride, for example. The aerosol engine cleaner kit also includes a male/dual-diameter flexhose coupler 12, a greater diameter coupling hose 16 and a lesser diameter coupling hose 17.

The greater diameter coupling hose 16 preferably has an inside diameter of about ½ inch (12.7 mm) and the lesser diameter coupling hose 17 preferably has an inside diameter of about ⅜ inch (9.5 mm). The coupling hoses 16 and 17 are each preferably from two to three inches (51 to 76 mm) long. The male/dual-diameter male flexhose coupler 12 is generally tubular in construction with a bore passing substantially axially through it. The coupler 12 has a barbed inlet fitting 13 adapted to be inserted into and snugly held by a discharge end of the flexhose 10. The male/dual-diameter male coupler 12 also has a lesser diameter barbed outlet fitting 14 at an end opposite to the inlet fitting 13. The lesser-diameter outlet fitting 14 is adapted to be inserted into and snugly held by an inlet end of the lesser diameter coupling hose 17. As shown in FIG. 8, intermediate between the inlet fitting 13 and the lesser diameter outlet fitting 14 on the male/dual-diameter male coupler 12 is a greater-diameter barbed outlet fitting 15. The greater-diameter outlet fitting 15 is adapted to be inserted into and snugly held by an inlet end of the greater-diameter coupling hose 16, with the lesser-diameter outlet fitting 14 extending into the hose of the greater-diameter coupling hose 16.

Figure 7:
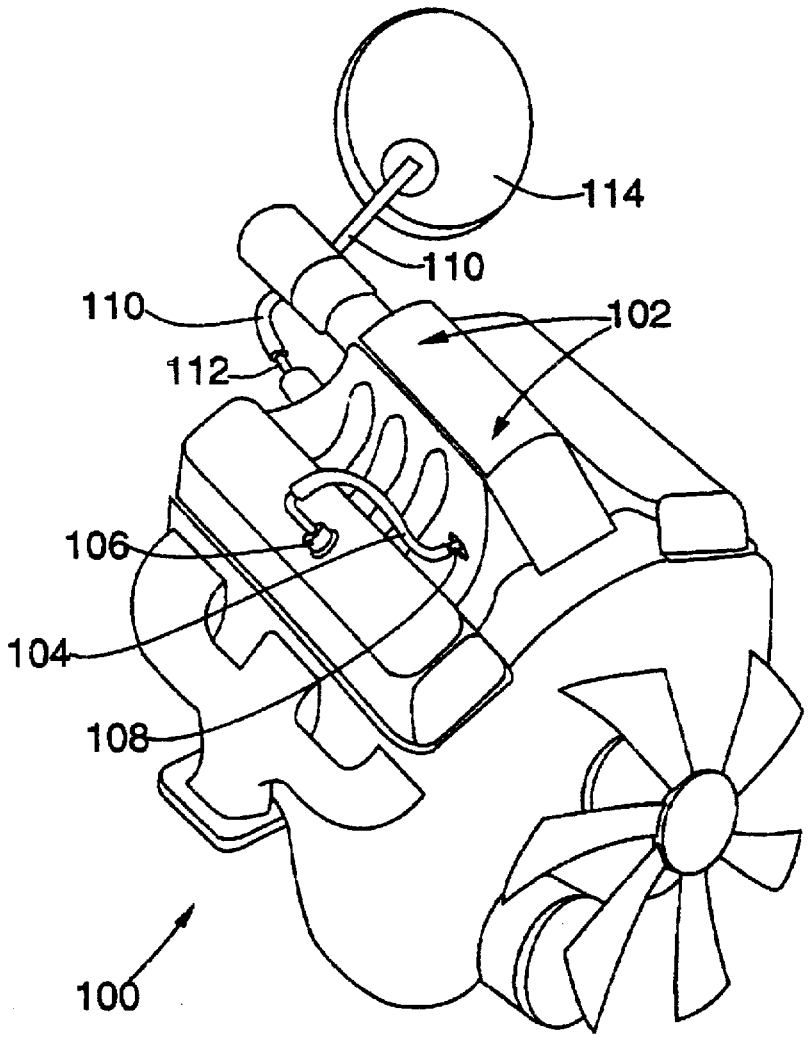
FIG. 7 is a simplified perspective drawing of an automobile engine illustrating three preferred locations for introducing a preferred engine-cleaner composition of the invention into an air-intake plenum of the engine.

The male/dual-diameter male flexhose coupler 12 together with the greater and lesser diameter coupling hoses 16 and 17 permit flexhose 10 to be coupled to standard-sized ports of the air-intake manifold of conventional internal combustion engines. As may be seen in FIG. 7, a conventional internal combustion engine 100 has an air-intake-plenum housing 102 which encloses an air-intake plenum (not shown). A positive crankcase ventilation ("PVC") hose 104 extends from a PVC valve 106 which communicates with an internal crankcase chamber of the engine to a PVC intake port fitting 108 which provides communication with the air-intake plenum through the air-take-plenum housing 102. The positive-crankcase-ventilation hose 104 conventionally has an inside diameter of about ⅜ inch (9.5 mm). To connect the flexhose 10 of the aerosol engine-cleaner kit 2 to the engine 100 for discharge of engine cleaner composition as an aerosol fog into the air-intake plenum of the engine, the positive-crankcase-ventilation hose 104 can be disconnected from the PVC intake port fitting 108 and the discharge end of the flexhose 10 connected to the PVC intake port fitting 108 by means of the male/dual-diameter male flexhose coupler 12 and the lesser-diameter coupling hose 17. As an alternative connection arrangement which may be more convenient in certain vehicles, the positive-crankhose-ventilation hose 104 can be left connected to the PVC intake port fitting 108 and disconnected from the PVC valve 106. The discharge end of the flexhose 10 can then be connected to the positive-crankcase-ventilation hose 104 by means of the male/dual-diameter male flexhose coupler 12.

A third alternative for connecting the flexhose 10 of the aerosol engine-cleaner kit 2 to the engine 100 for discharge of engine cleaner composition as an aerosol fog into the air-intake plenum of the engine involves a brake vacuum line 110 which extends from a brake-vacuum-line port fitting 112 in the air-intake plenum housing 102 to an air vacuum brake canister 114. In many vehicles, the brake vacuum line 110 has an inside diameter of either about ⅜ inch (9.5 mm) or about ½ inch (12.7 mm). To connect the flexhose 10 of the aerosol engine-cleaner kit 2 to the engine 100 for discharge of engine cleaner composition as an aerosol fog into the air intake plenum of the engine, the brake vacuum line 110 can be disconnected from the brake-vacuum-line port fitting 112 and the discharge end of the flexhose 10 connected to the brake-vacuum-line port fitting 112 by means of the male/dual-diameter male flexhose coupler 12 and the coupling hose 16 or 17 of the diameter corresponding to the diameter of the brake vacuum line 110.

The three to seven foot length of the flexhose 10 permits a person cleaning the engine to sit in the driver's seat of the vehicle for the cleaning operation. In a preferred embodiment of the present invention a cold concentrate chemical fog is transferred from the air intake plenum through the catalytic converter.

One particularly preferred engine-cleaning method for an automobile engine involves placing the gearshift of the automobile in park, then starting the engine and accelerating the engine to an engine speed of about 2500 RPM using the gas pedal. The push-button valve of the aerosol unit is then pressed to introduce engine cleaner composition into the air-throttle body of the engine. When engine speed starts to drop, the push-button valve of the aerosol unit is released. The press and release operation of the valve of the aerosol unit is repeated about four times in one minute; then the push-button valve is held down continuously until the engine stalls. The accelerator pedal is then released. The engine is then cranked with the starter motor for about 10 seconds, with the push-button valve of the aerosol unit fully depressed. The vehicle key is then switched off. The push-button valve is then depressed until the aerosol container unit empties, which is generally within one minute after the cranking is stopped. The engine is then allowed to "soak" for from about 10 to about 30 minutes. While the engine is soaking, the flexhose or the ⅜" barbed male probe is removed and the PCV line reconnected to the air throttle body or air intake plenum. A gasoline additive is then added to the fuel tank. When the soak period is over, the engine is started and brought to a speed of approximately 2500 RPM and held until all blue smoke leaves the exhaust, which generally takes two minutes or so.

Alternatively, the pressure-resistant container can be pressurized with a compressed gas such as carbon dioxide ($CO_2$), nitrous oxide ($NO_2$) or nitrogen ($N_2$). See Table III below, Formula Nos. 56, 57, 58 and 59. The aerosol unit is connected to the air throttle body and the engine cleaning process is carried out in essentially the same manner as outlined in the preceding paragraphs.

Although it is not recommended that any embodiment of the engine cleaner composition of the invention be ingested or inhaled in high concentrations, preferred engine cleaner compositions of the invention exhibit a low toxicity when used in accordance with the preferred engine cleaner method of the invention. When an engine is being cleaned by the engine cleaner method of the invention, exhaust gases from the engine when it is running or being cranked should be vented out-of-doors in accordance with standard, safe garage-operation practice for handling automobile-engine exhaust. Running an engine after soaking with a preferred engine cleaner composition of the invention can lead to an increase in the concentration of nitrous oxide ($NO_2$) in the exhaust relative to the concentration under conditions of ordinary operation of the engine.

Best and Preferred Modes for Carrying out The Invention

Test methods for determining product cleaning efficacy have been developed. Such methods have been used to obtain data on the relative cleaning efficiency of individual chemicals and of combinations of two or three or four chemicals that may show synergistic activity, or on completely formulated concentrates. The following screening method—termed the "cold spark-plug immersion test" ("CSPIT")—was found to be useful in predicting the efficiency of a test cleaning agent for cleaning surfaces of internal combustion engines subject to fouling:

a. Carefully remove a soiled spark plug from an engine;

b. Using an air knife, blow away any loose contamination and note the visual appearance of spark plug;

c. Weigh the soiled spark plug;

d. Immerse the soiled spark plug in the test liquid for about 10 minutes at approximately 70° F.;

e. Remove the spark plug from the test liquid and rinse it momentarily with water at ambient temperature;

f. Air dry or blow gently with an air knife until dry;

g. Re-weigh the spark plug and note the weight loss due to soil removal;

h. Note the visual appearance of the dry spark plug after immersion in the test liquid and estimate the approximate percent of soil removal based on the original appearance of the soiled spark plug;

i. Visually inspect the test solution and estimate the percent of soil dissolved from the discoloration of the solution;

j. Using a mild abrasive buffing wheel or an ultrasonic cleaning bath, remove all soil left on the spark plug, if any;

k. Re-weigh the cleaned spark plug and note the weight loss; and l. Calculate percent soil removal due to immersion in the test liquid from the weighings in steps c, g, and k and estimate the percent soil removal from the visual inspections in steps b, h, and i.

If the three estimations of percent soil removal closely agree, then record the percent soil removal. If they do not agree, repeat the test with another soiled spark plug.

In the cold spark plug immersion test, it is necessary to separate soiled spark plugs into three categories:

a) heavy, baked-on varnish/sludge deposits;

b) light, baked-on varnish/sludge deposits;

c) highly carbonized, baked-on varnish/sludge deposits.

The tests described below were conducted on category "a" type plugs unless indicated otherwise.

In addition to the CSPIT screening tests, cleaning effectiveness tests have been made on automotive engines. Such tests—termed "hot engine cleaning tests" ("HECT")—are based on determination of such attributes as:

a) Cleaning of oxygen sensors: measured by observing signal patterns from the sensors with the oscilloscope of a pinpoint tester before and after cleaning;

b) Conducting a cylinder power balance test before and after cleaning;

c) Dynamic firing voltages (kV), measured before and after cleaning;

d) Firing duration, measured before and after cleaning;

e) Exhaust gas emissions, analyzed before and after cleaning;

f) Pinpoint test of injector pulse width, measured before and after cleaning; and g) Minimum smooth idling speed, measured before and after cleaning.

Test engine cleaner compositions that rate 50 percent soil removal or better from the cold spark-plug immersion test "CSPIT" test when tested in an engine were generally found to produce excellent results in the hot engine cleaning tests "a" through "g." In the case of preferred engine cleaner formulas of the subject invention, "CSPIT" removal of about 50 percent or greater is considered to be desirable, and removal of about 75 percent or greater is considered to be exceptionally good.

Tables I, II and III below set forth the results of "CSPIT" tests carried out on spark plugs with a category "a" soil rating using various test compounds and multicomponent test compositions. The percentages noted for the components of the multicomponent test compositions refer to weight percentages based on the total weight of the composition.

TABLE I

| Test Compounds | % of Soil Removal Using "CSPIT" Test For About 10 Minutes and a Spark Plug With Soil Rating "a" |
|---|---|
| 1. 2-methyl-1,5-Bis(2-oxopyrrolidin-1-yl)pentane ["ACS 2002"] | 10 |
| 2. N-cyclohexyl-2-pyrrolidone ["CHP"] | 20 |
| 3. 2-furfurylamine | 40 |
| 4. N-methyl-2-pyrrolidone | 40 |
| 5. 2-pyrrolidone | 30 |
| 6. isopropylamine dodecylbenzene sulfonate (CAS No. 26264-05-1) ["P-1059"] | 3 |
| 7. polyoxyalkylated alkyl phosphate ester (CAS No. 68071-35-2) ["PS 222"] | 1 |
| 8. azeotrope of acetonitrile and water | 0 |
| 9. deionized water | 0 |
| 10. toluene | 0 |

TABLE II

| Multi Component Test Compositions | | "CSPIT" Test |
|---|---|---|
| 11. 2-methyl-1,5-Bis(2-oxopyrrolidin-1-yl)pentane | 75% | 20 |
| azeotrope of acetonitrile and water | 25% | |
| 12. 2-methyl-1,5-Bis(2-oxopyrrolidin-1-yl)pentane | 50% | 40 |
| azeotrope of acetonitrile and water | 50% | |
| 13. 2-methyl-1,5-Bis(2-oxopyrrolidin-1-yl)pentane | 25% | 50 |
| azeotrope of acetonitrile and water | 75% | |
| 14. N-cyclohexyl-2-pyrrolidone | 75% | 70 |
| azeotrope of acetonitrile and water | 25% | |
| 15. N-cyclohexyl-2-pyrrolidone | 50% | 60 |
| azeotrope of acetonitrile and water | 50% | |
| 16. N-cyclohexyl-2-pyrrolidone | 25% | 30 |
| azeotrope of acetonitrile and water | 75% | |
| 17. 2-furfurlyamine | 75% | 80 |
| azeotrope of acetonitrile and water | 25% | |
| 18. 2-furfurlyamine | 50% | 80 |
| azeotrope of acetonitrile and water | 50% | |
| 19. 2-furfurlyamine | 25% | 50 |
| azeotrope of acetonitrile and water | 75% | |

TABLE II-continued

| Multi Component Test Compositions | | "CSPIT" Test |
|---|---|---|
| 20. N-methyl-2-pyrrolidone | 75% | 50 |
| azeotrope of acetonitrile and water | 25% | |
| 21. N-methyl-2-pyrrolidone | 50% | 50 |
| azeotrope of acetonitrile and water | 50% | |
| 22. N-methyl-2-pyrrolidone | 25% | 40 |
| azeotrope of acetonitrile and water | 75% | |
| 23. 2-pyrrolidone | 75% | 60 |
| azeotrope of acetonitrile and water | 25% | |
| 24. 2-pyrrolidone | 50% | 50 |
| azeotrope of acetonitrile and water | 50% | |
| 25. 2-pyrrolidone | 25% | 40 |
| azeotrope of acetonitrile and water | 75% | |
| 26. isoproplyamine dodecylbezene sulfonate | 75% | 2 |
| azeotrope of acetonitrile and water | 25% | |
| 27. isoproplyamine dodecylbezene sulfonate | 50% | 0 |
| azeotrope of acetonitrile and water | 50% | |
| 28. isoproplyamine dodecylbezene sulfonate | 25% | 0 |
| azeotrope of acetonitrile and water | 75% | |
| 29. N-cyclohexyl-2-pyrrolidone | 33.3% | 80 |
| 2-furfuryzamine | 33.3% | |
| azeotrope of acetonitrile and water | 33.3% | |
| 30. ACS 2002 | 33.3% | 70 |
| CHP | 33.3% | |
| azeotrope of acetonitrile and water | 33.3% | |
| 31. CHP | 33.3% | 70 |
| N-methyl-2-pyrrolidone | 33.3% | |
| azeotrope of acetonitrile and water | 33.3% | |
| 32. CHP | 33.3% | 65 |
| 2-pyrrolidone | 33.3% | |
| azeotrope of acetonitrile and water | 33.3% | |
| 33. ACS 2002 | 33.3% | 75 |
| 2-furfurylamine | 33.3% | |
| azeotrope of acetonitrile and water | 33.3% | |
| 34. 2-furfurylamine | 33.3% | 85 |
| N-methyl-2-pyrrolidone | 33.3% | |
| azeotrope of acetonitrile and water | 33.3% | |
| 35. ACS 2002 | 33.3% | 65 |
| N-methyl-2-pyrrolidone | 33.3% | |
| azeotrope of acetonitrile and water | 33.3% | |
| 36. 2-furfurylamine | 33.3% | 80 |
| 2-pyrrolidone | 33.3% | |
| azeotrope of acetonitrile and water | 33.3% | |
| 37. CHP | 30.0% | 80 |
| 2-furfurlamine | 30.0% | |
| azeotrope of acetonitrile and water | 30.0% | |
| isopropylamine dodecylbenzene sulphonate | 10.0% | |
| 38 ACS 2002 | 30.0% | 75 |
| 2-furfurlamine | 30.0% | |
| azeotrope of acetonitrile and water | 30.0% | |
| P-1059 | 10.0% | |
| 39. ACS 2002 | 30.0% | 60 |
| CHP | 30.0% | |
| azeotrope of acetonitrile and water | 30.0% | |
| P-1059 | 10.0% | |
| 40. CHP | 26.6% | 80 |
| 2-furfurylamine | 26.7% | |
| azeotrope of acetonitrile and water | 26.7% | |
| P-1059 | 20.0% | |
| 41. CHP | 26.6% | 80 |
| 2-furfurylamine | 23.3% | |
| azeotrope of acetonitrile and water | 23.4% | |
| P-1059 | 30.0% | |
| 42. CHP | 20.0% | 75 |
| 2-furfurylamine | 20.0% | |
| azeotrope of acetonitrile and water | 20.0% | |
| P-1059 | 40.0% | |
| 43. CHP | 16.6% | 60 |
| 2-furfurylamine | 16.6% | |
| azeotrope of acetonitrile and water | 16.8% | |
| P-1059 | 50.0% | |
| 44. ACS 2002 | 16.6% | 60 |
| 2-furfurylamine | 16.6% | |
| azeotrope of acetonitrile and water | 16.8% | |
| P-1059 | 50.0% | |
| 45. ACS 2002 | 25.0% | 80 |
| 2-furfurylamine | 25.0% | |

TABLE II-continued

| Multi Component Test Compositions | | "CSPIT" Test |
|---|---|---|
| azeotrope of acetonitrile and water | 25.0% | |
| P-1059 | 20.0% | |
| PS222 | 5.0% | |
| 46. CHP | 25.0% | 80 |
| 2-furfurylamine | 25.0% | |
| azeotrope of acetonitrile and water | 25.0% | |
| P-1059 | 20.0% | |
| PS222 | 5.0% | |
| 47. ACS 2002 | 15.0% | 80 |
| 2-furfurylamine | 30.0% | |
| azeotrope of acetonitrile and water | 20.0% | |
| P-1059 | 30.0% | |
| PS222 | 5.0% | |
| 48. CHP | 30.0% | 75 |
| 2-furfurylamine | 15.0% | |
| azeotrope of acetonitrile and water | 20.0% | |
| P-1059 | 30.0% | |
| PS222 | 5.0% | |
| 49. CHP | 30.0% | 75 |
| 2-furfurylamine | 20.0% | |
| azeotrope of acetonitrile and water | 20.0% | |
| P-1059 | 20.0% | |
| PS. 222 | 5.0% | |
| diethylamine | 5.0% | |

TABLE III

| Composition | | "CSPIT" Test |
|---|---|---|
| 50. CHP | 7.50% | 65 |
| 2-furfurylamine | 5.70% | |
| azeotrope of acetonitrile and water | 6.80% | |
| P-1059 | 5.00% | |
| PS222 | 0.85% | |
| toluene | 29.15% | |
| A-46 propellant | 45.00% | |
| 51. ACS 2002 | 4.0% | 50 |
| 2-furfurylamine | 5.0% | |
| azeotrope of acetonitrile and water | 5.0% | |
| P-1059 | 8.0% | |
| PS222 | 3.0% | |
| toluene | 30.0% | |
| A-46 propellant | 45.0% | |
| 52. ACS 2002 | 3.0% | 75 |
| CHP | 6.0% | |
| 2-furfurylamine | 9.0% | |
| azeotrope of acetonitrile and water | 5.0% | |
| P-1059 | 6.0% | |
| PS222 | 1.0% | |
| toluene | 30.0% | |
| A-46 propellant | 40.0% | |
| 53. ACS 2002 | 4.0% | 75 |
| CHP | 3.0% | |
| 2-furfurylamine | 10.0% | |
| azeotrope of acetonitrile and water | 7.0% | |
| P-1059 | 8.0% | |
| PS222 | 3.0% | |
| toluene | 25.0% | |
| A-46 propellant | 40.0% | |
| 54. ACS 2002 | 50.0% | 75 |
| CHP | 3.0% | |
| 2-furfurylamine | 10.0% | |
| azeotrope of acetonitrile and water | 7.0% | |
| P-1059 | 8.0% | |
| PS222 | 3.0% | |
| toluene | 34.0% | |
| fluorohydrocarbon "134-a" propellant | 30.0% | |
| 55. ACS 2002 | 3.0% | 70 |
| 2-pyrrolidone | 7.0% | |
| 2-furfurylamine | 8.0% | |
| azeotrope of acetonitrile and water | 7.0% | |
| P-1059 | 8.0% | |

TABLE III-continued

| Composition | | | "CSPIT" Test |
|---|---|---|---|
| | PS222 | 3.0% | |
| | toluene | 34.0% | |
| | fluorohydrocarbon "134-a" propellant | 30.0% | |
| 56. | ACS 2002 | 4.0% | 75 |
| | N-methyl-2-pyrrolidone | 10.0% | |
| | CHP | 8.0% | |
| | azeotrope of acetonitrile and water | 8.0% | |
| | P-1059 | 8.0% | |
| | PS222 | 3.0% | |
| | ethanol or methanol | 56.0% | |
| | nitrous oxide ($N_2O$) | 3.0% | |
| 57. | ACS 2002 | 4.0% | 85 |
| | N-methyl-2-pyrrolidone | 10.0% | |
| | 2-pyrrolidone | 8.0% | |
| | azeotrope of acetonitrile and water | 8.0% | |
| | P-1059 | 8.0% | |
| | PS222 | 4.0% | |
| | toluene | 30.0% | |
| | isopentane or hexane or heptane | 25.0% | |
| | nitrous oxide ($N_2O$) | 3.0% | |
| 58. | ACS 2002 | 4.0% | 80 |
| | N-methyl-2-pyrrolidone | 10.0% | |
| | 2-pyrrolidone | 8.0% | |
| | azeotrope of acetonitrile and water | 8.0% | |
| | P-1059 | 8.0% | |
| | PS222 | 3.0% | |
| | ethanol or methanol | 30.0% | |
| | isopropyl alcohol | 25.0% | |
| | carbon dioxide ($CO_2$) | 4.0% | |
| 59. | ACS 2002 | 4.0% | 85 |
| | N-methyl-2-pyrrolidone | 10.0% | |
| | 2-pyrrolidone | 8.0% | |
| | azeotrope of acetonitrile and water | 8.0% | |
| | P-1059 | 8.0% | |
| | PS222 | 3.0% | |
| | toluene | 23.7% | |
| | isopentane | 35.0% | |
| | nitrogen ($N_2$) | 0.3% | |
| 60. | N-methyl-2-pyrrolidone | 10.0% | 85 |
| | CHP | 6.0% | |
| | 2-furfurylamine | 6.0% | |
| | azeotrope of acetonitrile and water | 8.0% | |
| | toluene | 20.00% | |
| | dimethyl ether (D.M.E.) | 50.00% | |
| 61. | N-methyl-2-pyrrolidone | 10.71% | 90 |
| | CHP | 5.36% | |
| | 2-furfurylamine | 5.36% | |
| | azeotrope of acetonitrile and water | 8.57% | |
| | A-46 propellant | 20.00% | |
| | dimethyl ether (D.M.E.) | 50.00% | |

Because of the solvent ability of dimethyl ether, surfactants are not used in formulas Nos. 60 and 61. In formula 56, methanol is generally preferred for reasons of economy. In formula 57 isopentane is the more volatile than hexane or heptane and so is generally preferred.

In order to clean effectively engine fuel system components subject to fouling by carbonaceous deposits—e.g. the intake air throttle body, the fuel injectors, the intake valves, the combustion chambers, the spark plugs, exhaust valves, the oxygen sensor and the catalytic converter—using a cleaning composition introduced into the air intake system, compressed liquid gas provides an ideal vehicle. Formulas Nos. 50 through 59 contain surfactants—isopropyalmine dodecylbenzene sulfonate and polyoxyalkylated alkyl phosphate ester—at concentrations effective to solubilize the cyclic compounds into the compressed liquid propellants.

When an engine-cleaner composition and propellant is sprayed from an aerosol unit into the air-intake system of a warmed-up internal combustion engine, the stream of liquid rapidly expands, since the liquid stream is in a pressure environment of substantially one atmosphere and in an intake manifold that generally averages above 130° F. The rapid expansion of the liquid propellant to a gas micronizes the engine-cleaner composition actives into droplets of which most are less than roughly one micron size. In the case of preferred engine-cleaner compositions of the invention, a dense cloud of fog of synergistic heterocyclic ring compounds and acetonitrile/water azeotrope is thus created. This dense active fog is carried throughout all areas of the upper engine system.

The small particle chemical fog having an average liquid particle size less than 0.1 micron obtained in the practice of the present invention is used as the mechanism for providing the cleansing of engine parts. In the operation of the process, the pressure of the aerosol propellant together with the vacuum created by spinning the engine using the vehicle's starter pulls the fog through all areas of the air intake plenum, the plenum runners wetting each intake valve and the valve housing and all areas of the combustion chambers and spark plugs. Then, the chemical fog is pushed out and in so doing wets the exhaust valves, the oxygen sensor and the catalytic converter. Studies have shown that the deposits which dirty the fuel injectors start at the outside tip of the injector and plates back up to the pintlet needle, such deposits interfering with the injector fuel spray pattern and the fuel volume. As the micro chemical fog wets the injector tips and the surfaces around the pintlet needle it removes oil deposits and returns the fuel characteristics to o.e.m. specifications.

In order to obtain a small particle chemical fog, it is generally necessary to use greater than 50% , by volume, liquid propellant and over 70% is a preferred level. Additionally, creation of a swirling action in the liquid spray using a mechanical break-up adapter shown in FIGS. 14 and 16 with fog-generating inserts shown in FIGS. 15, 17, and 18 is a preferred embodiment of the present invention. The swirling liquid spray super cools as it expands into a fog. It has been determined that when the cool fog first wets the hot soiled engine fuel system component surfaces, a network of small cracks occur on the surface of the soil, so permitting the cleaning channels to penetrate the soil more rapidly. Instant cracking and pulling of the soil ofttimes occurs on some of the valve intake housings. As the fog droplets warm, the propellant tends to fractionate from the cleaning fluid, thereby leaving the chemical droplets in a concentrated form. High boiling chemicals in the composition tend to precipitate against all surfaces like a fog impinging upon a cold mirror.

Figure 12:
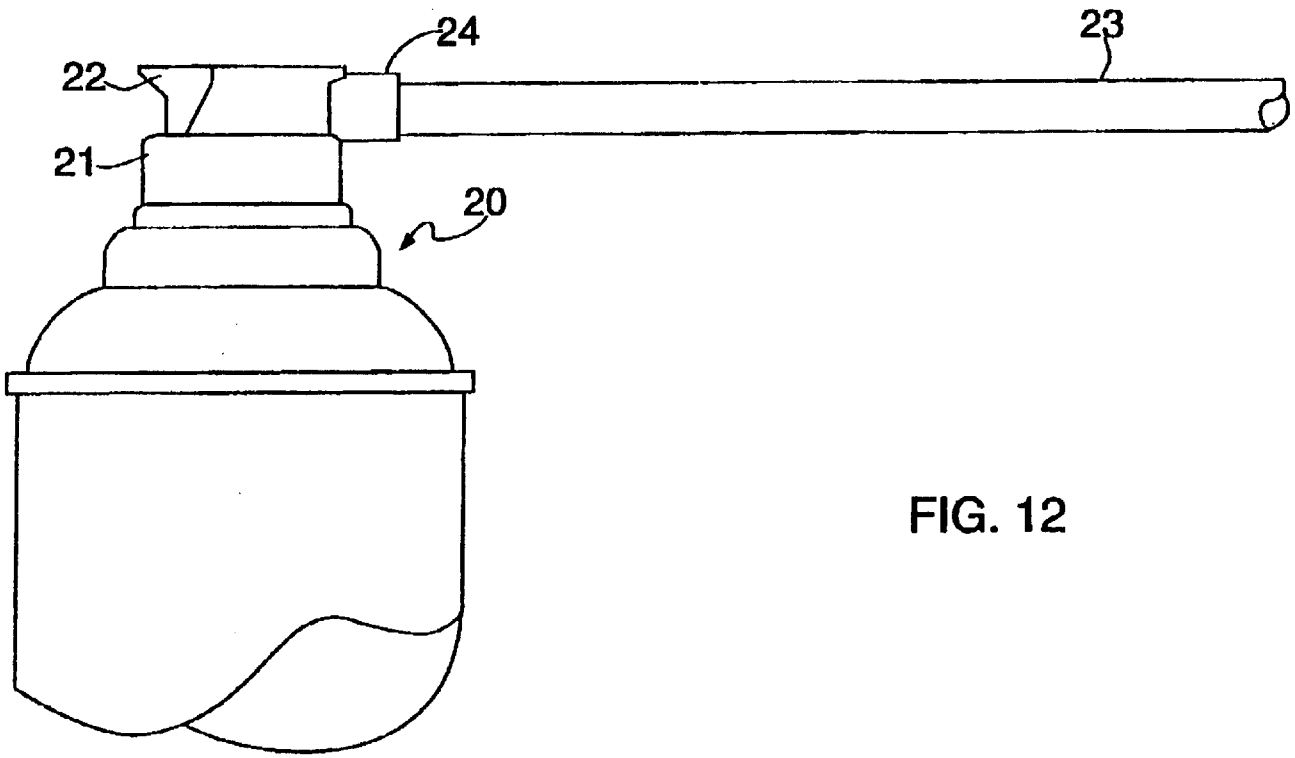
FIG. 12 is a front elevational view of an aerosol actuator with a protective plastic cover employed in the practice of the invention.

With reference now to FIG. 12, there is shown a side elevational view of an aerosol actuator used in the practice of a preferred embodiment of the present invention. Shown is an aerosol actuator valve 21 adapted to be connected to an outlet of a pressure-resistant aerosol container 20. The aerosol actuator valve 21 has a protective plastic cover 22 which is connected to a thick walled translucent plastic discharge tube 23 by means of a plastic lock sleeve 24. The discharge tube 23 has in outside diameter of about 5/16 inch (7.9 mm) and an inside diameter of about 3/16 inch (4.8 mm). The discharge tube 23 is about three feet (900 mm) long.

Figure 13:
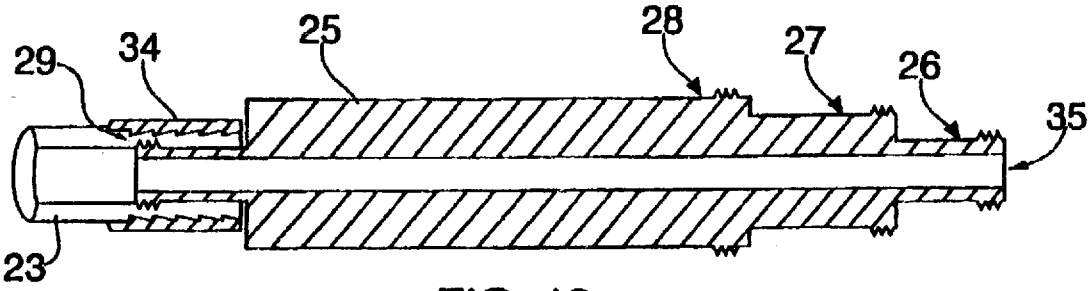
FIG. 13 is a cross-sectional view of a preferred male/three-diameter male uniform bore adapter employed in the practice of the invention.

Turning now to FIG. 13, a male/triple-diameter male uniform-bore adapter 25 has a barbed inlet fitting 29 which fits into the discharge tube 23 of FIG. 12. The discharge tube 23 is locked on to the inlet fitting 29 of the adapter 25 by means of lock sleeve 34. An air-intake plenum side of adapter 25 is designed to fit into the bores of flexhoses of three different diameters that are standard components of air intake plenums of conventional vehicles. A small-diameter barbed tip 26 of the adapter 25 fits into a hose with an inner diameter of approximately 3/16 inch (4.8 mm), medium-diameter barbed tip 27 fits into a hose with an inner diameter of approximately 3/8 inch (9.5 mm), and a large-diameter barbed tip 28 fits into a hose with an inner diameter of approximately ½ inch (12.7 mm). The uniform-bore adapter 25 has a bore 35 which extends axially through the adapter. The bore 35 has an essentially a uniform diameter of about 0.1 inch (2.5 mm) throughout. Discharging engine-cleaner composition through the bore 35 of the male/triple-diameter male straight-through adapter 25 tends to produce non-mechanical break-up spray characteristics.

Figure 14:
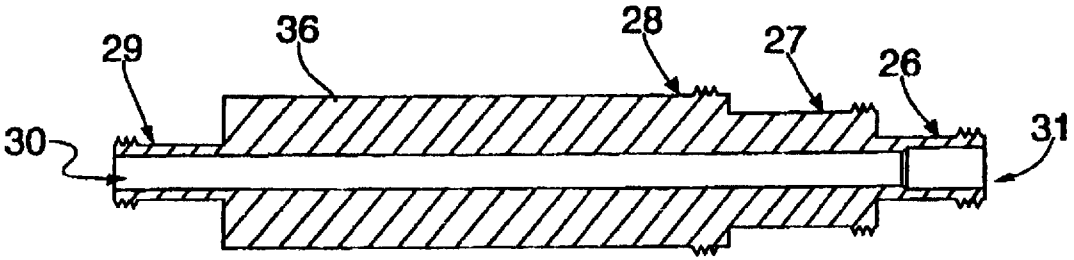
FIG. 14 is a cross-sectional view of a preferred male/three-diameter male insert-holder adapter.
Figure 15:
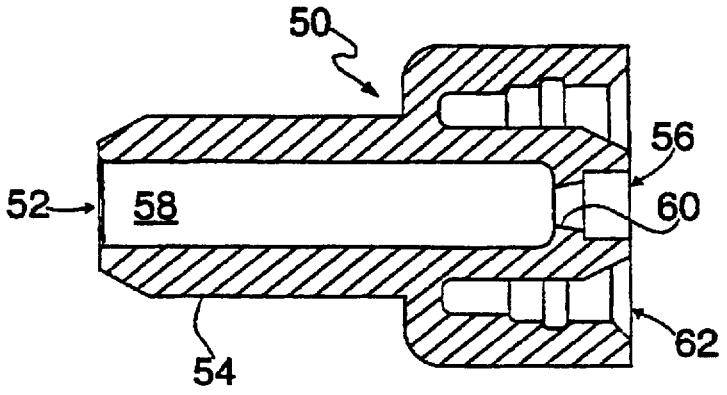
FIG. 15 is a cross sectional view of a preferred semi mechanical break-up spray insert for use with the insert holder adapter of FIG. 14.

FIG. 14 is a cross-sectional view of a male/triple-diameter male insert-holder adapter 36. The insert-holder adapter 36 of FIG. 14 is similar in structure to the uniform-bore adapter 25 shown in FIG. 13 with the exception that a bore 30 passing axially through the insert-holder adapter 36 is enlarged in diameter at an exit end to form an insert-holder socket 31. Turning now to FIG. 15, a semi-mechanical break-up spray insert 50 is shown in an expanded scale relative to the scale of the insert-holder adapter 36 of FIG. 14. The semi-mechanical break-up spray insert 50 is generally cylindrically symmetric in construction with a break-up spray bore 52 extending axially through the insert. An insert plug fitting 54 projects from an inlet end of the break-up spray insert 50. The insert plug fitting 54 is shaped and dimensioned to be inserted in the insert-holder socket 31 of the insert-holder adapter 36 and held in the socket 31 by a press-fit mechanism. An outlet end of the break-up spray bore 52 is shaped to form a semi-mechanical break-up spray orifice 56. An inlet end 58 of the break-up spray bore 52 is approximately 0.076 inch (1.9 mm) in diameter. At the outlet end, a radially inwardly projecting annular strip 60 constricts the bore 52 to a diameter of about 0.056 inch (1.4 mm) on an upstream side, which increases generally linearly in a downstream direction to a diameter of about 0.060 inch (1.5 mm). The projecting strip is about 0.022 inch (0.6 mm) wide in an axial direction. The diameter of the bore 52 increases downstream of the projecting strip 60 to a diameter of about 0.067 inch (1.7 mm) for a length of about 0.034 inch (0.9 mm). A generally annular groove 62 encircles the semi-mechanical break-up spray orifice 56 to receive and hold an end of a flexhose. In operation, liquid back pressure exerted on the different sized exit openings produces a semi-mechanical break-up spray of engine-cleaner composition passing through the semi-mechanical break-up spray orifice 56 to form an aerosol fog of the composition.

Figure 16:
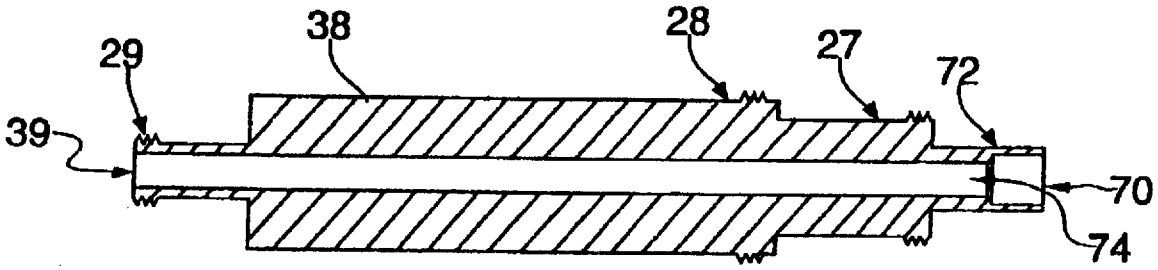
FIG. 16 is a cross-sectional view of a preferred male/three-diameter male dual-insert-holder adapter.

Turning now to FIG. 16, a male/triple-diameter male dual-insert-holder adapter 38 is generally similar in construction to the uniform-bore adapter 25 of FIG. 13 with the exception that a small diameter fitting 72 at the outlet end is not barbed in the dual-insert-holder adapter 38 and a bore 39 which extends axially through the dual-insert-holder adapter 38 is enlarged in diameter at an outlet end to define a dual-insert-holder socket 70. Turning now to FIG. 17*a*, a Maltese-cross upstream insert 76 is shown for clarity in an expanded scale relative to the dual-insert-holder adapter 38 of FIG. 16. The upstream insert 76 has a Maltese-cross plug fitting 78 which projects from an upstream-insert body member 80. The plug fitting 78 has a Maltese-cross shape in cross section, as may be seen FIG. 17*b*. As shown in FIG. 17*a* and 17*c*, the upstream-insert body member 80 is generally circularly cylindrical in shape. The Maltese-cross upstream-insert 76 is shaped and dimensioned to be inserted in and held in the dual-insert-holder socket 70 of the dual-insert-holder adapter 38, with the Maltese-cross plug fitting 78 projecting into an outlet end portion 74 of the bore 39 of the adapter 38. The upstream-insert 76 is held in place by radially inner walls of the outlet end portion 74 of the bore 39 bearing against radially outer surfaces of the arms of the Maltese-Cross-shaped plug fitting 78 in a press-fit relationship. The outer diameter of the upstream-insert body member 80 is less than the inner diameter of the dual-insert holder socket 70, so that when the Maltese-cross upstream insert 76 is positioned in the bore of the adapter, an annular channel is defined between radially-outer surfaces of the body member 80 and radially inner surfaces of the holder socket 70. Four axially extending grooves 84 are defined along the Maltese-cross plug fitting 78 by the cross-shaped cross section of the fitting. Each of the four axially extending grooves 84 is connected to a corresponding generally radial groove 82 formed in an upstream base of the upstream-insert body member 80, as shown in FIG. 17*a*. The axially-extending grooves 84, the radial grooves 82 and the annular channel (not shown) between radially outer surfaces of the upstream insert body member 80 and radially inner surfaces of the holder socket 70 permit fluid to flow from the inlet end of the bore 39 of the adapter 38 into the holder socket 70.

Turning now to FIG. 18*a*, a downstream swirl-flow cap insert is shown in an expanded scale relative to the dual insert holder adapter 38 of FIG. 16. The downstream cap insert 86 is generally circular in cross section, as may be seen in FIGS. 18*b* and 18*c*. The downstream cap insert 86 is dimensioned to be inserted in and held by the holder socket 70 of the dual insert holder adapter 38 in a press-fit arrangement downstream of the upstream insert 78. An interior cavity of the insert 86 is shaped to define a swirl chamber 88. The downstream cap insert 86 is oriented in the holder socket 70 of the adapter 38 with an inlet opening 94 of the swirl chamber 88 facing upstream towards the Maltese-cross upstream insert 78. Radial-offset grooves 90 are formed in an upstream-facing downstream face of the swirl chamber 88 of the cap insert 86, as may be seen best in FIG. 18*b*. The grooves 90 are about 0.01 inch (0.3 mm) deep by about 0.01 inch (0.3 mm) wide. A stepped diameter orifice 92 provides a fluid outlet from the interior of the swirl chamber 88. The stepped diameter orifice 92 has an upstream diameter of about 0.06 inch (1.5 mm) and a downstream exit diameter of about 0.04 inch (1 mm).

The Maltese-cross upstream insert 76 and the swirl chamber downstream cap insert 86 when mounted in the dual insert adapter 38 cooperate in operation to produce a full mechanical break up of engine-cleaner composition flowing through the bore 39 of the adapter to generate an aerosol fog of the composition.

Figure 19:
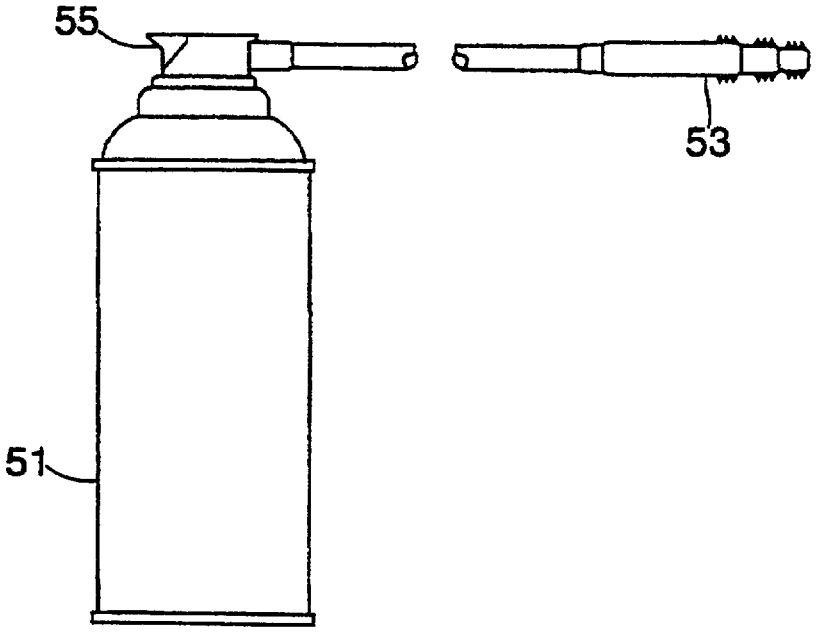
FIG. 19 is a side view, in perspective, of an aerosol unit employed in the practice of the invention which has been fitted with an over cap actuator with an adapter.

FIG. 19 is a side view, in perspective of an aerosol unit 51 fitted with an over cap actuator 55 having an adapter 53 of the invention attached thereto.

A preferred process for cleaning internal combustion engines is as follows:

1. Fully warm the engine of interest.
2. Disconnect the electrical harness leading to all of the fuel injectors.
3. Disconnect a rubber vacuum line that connects to the air intake plenum.
4. Connect a small two inch (2") piece of rubber hose to the exposed probe on the plenum shown in FIG. 20.
5. Connect the three stage adapter to this small rubber hose as shown in FIG. 19.
6. Fully actuate the aerosol unit and spray for 3–4 seconds. Then, using the vehicle's starter, spin the engine for 10 seconds while fully actuating the spray.
7. Stop the cranking but continue to spray for 3 seconds at which time spraying is stopped.

8. The hot engine is the permitted to soak for a time period within the range of 10–20 minutes.
9. Steps 6, 7 and 8 are then repeated.
10. Disconnect the adapter, remove the small rubber hose and reconnect the vacuum line.
11. Reconnect the electrical harness leading to the fuel, injectors.
12. Press the gas pedal to the floor and start the engine, holding the rpm at about 2,500 for two minutes or until the exhaust smoke disappears. At that point, the accelerator is snapped to 4,000 rpm a few times making sure all loose carbon is blown out the exhaust. At that point, the engine fuel component systems are clean.

This cleaning procedure should be repeated once or twice a year or every 12,000 to 15,000 miles to keep the engine clean and operating at maximum efficiency while maintaining emission at minimum levels.

FIG. 8 shows preferred hoses and adapters for introducing one preferred engine-cleaner composition of the invention into the air-throttle body of an automotive engine. Preferably, the hose has an internal diameter of about 3/16 inch or less, which tends to prevent the propellant from expanding and supercooling the product at the exit of the actuator. Supercooling in the hose tends to cause a spray of larger particles and liquid, which tends to cause hot spots and prevents complete engine saturation and optimum engine cleaning.

Engine cleaning hot-soak studies were conducted on fully warmed-up engines to determine an engine cleaning time required to return engine-fuel system components to O.E.M. specifications. The soak times in the engine cleaning process were compared to the "CSPIT" test results obtained with the same engine-cleaning composition. Formula No. 51 had a rating of about 50 percent on the "CSPIT" procedure and required approximately 30 minutes soak time to clean engine fuel-system components to O.E.M. specifications. Formula No. 50 had a rating of 65 percent from the "CSPIT" procedure and required approximately 20 minutes soak time to clean engine fuel-system components to O.E.M. specifications. Formulas Nos. 52, 53, 54, 55 and 56 had ratings of from about 70 to about 75 percent from the "CSPIT" procedure and required from 15 to approximately 20 minutes soak time to clean engine fuel-system components to O.E.M. specifications. Formulas Nos. 57, 58 and 59 had ratings of from about 80 to 85 percent from the "CSPIT" procedure and required from about 10 to about 15 minutes soak time to clean engine fuel-system components to O.E.M. specifications.

Boroscope examination of upper engine surfaces before and after treatment with a preferred engine cleaner of the invention by approximately one-minute pulse spraying with the cleaner with the engine running at approximately 2500 RPM shows the areas that were covered with thin layers of carbonaceous deposits and varnish were effectively cleaned. Boroscope examination after saturating substantially all areas with the active fog and hot soaking from about 10 to about 30 minutes shows that the higher boiling ring compounds condense on substantially all internal surface areas, slowly turning the carbonaceous deposits to a black running liquid. This liquid is either washed off by gasoline when the engine is restarted or is blown off by the hot violent gas movement when the engine is running at an engine speed of approximately 2000 RPM. When there is heavy coking on the intake valve tulip pad, the high-boiling synergistic ring compounds soak into the spongy coke deposits, loosening, softening and dissolving the coke.

Removal of the coke deposits may be facilitated by the use of a gasoline additive. The preferred additive for this purpose is 2-furfurylamine at a concentration of from about 25 to about 30 grams in approximately fifteen gallons of gasoline. A trade gasoline additive commercially available from Exxon Chemical Co. under the trade name "Paradyn 741" is also effective for facilitating the cleaning action of the ring compounds at a concentration of from 50 to about 60 grams per 15 gallons of gasoline. Alkylamine surfactants in the gasoline additives help gasoline to wash off the softened spongy coke residue that remains on the valve tulip pad after hot soaking.

Figure 10:
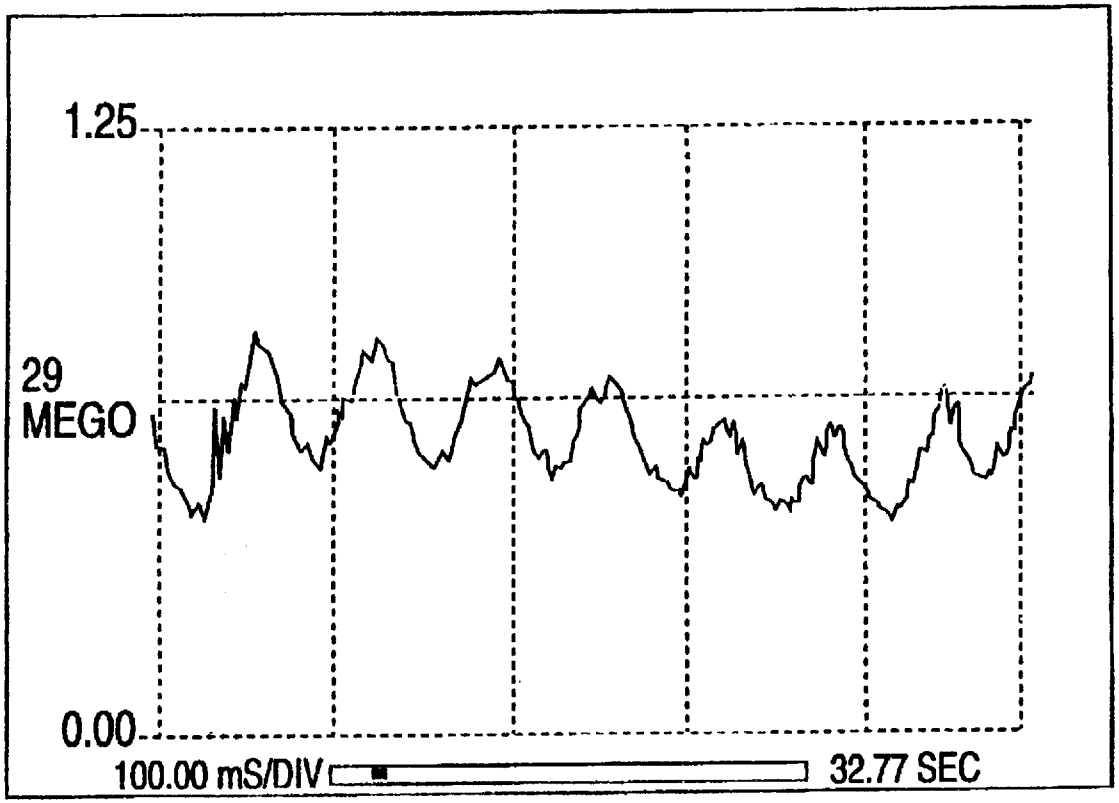
FIG. 10 is an oscilloscope trace of a signal from an oxygen sensor of an automobile engine before cleaning.
Figure 11:
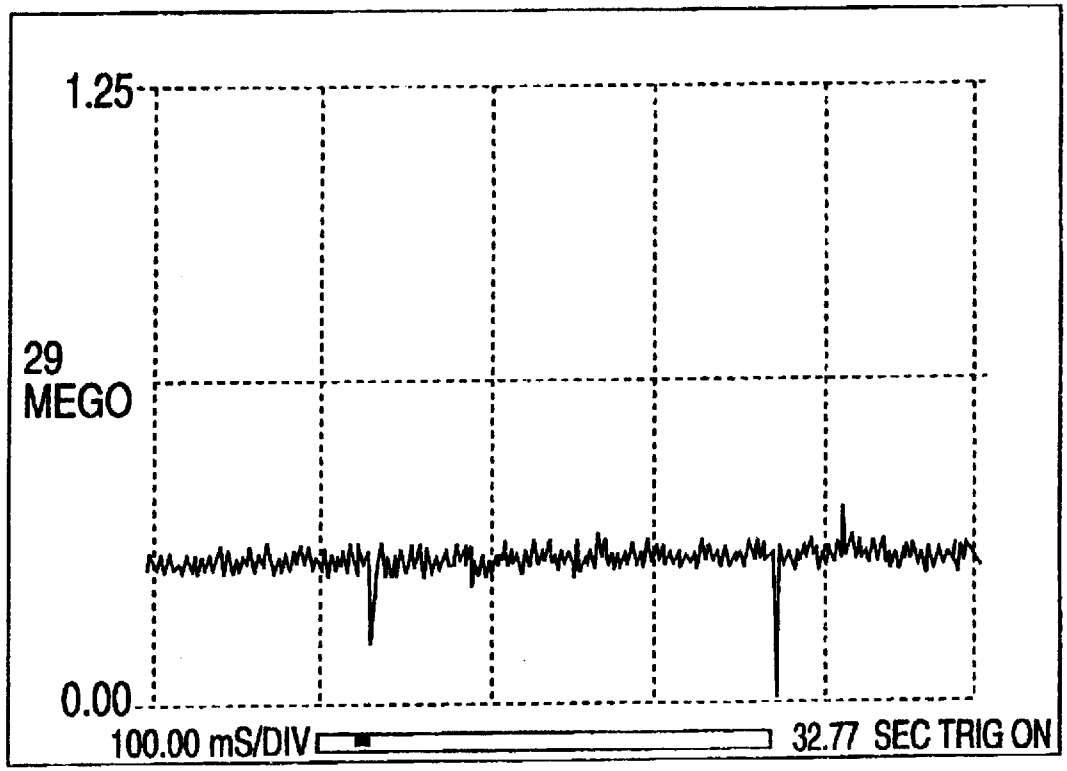
FIG. 11 is an oscilloscope trace of a signal from the oxygen sensor of the automobile engine of FIG. 10 after cleaning by a preferred engine cleaner method of the invention.

FIG. 10 shows the electrical response of an oxygen sensor in a six-cylinder, 4.9-liter electronic fuel injection engine before the engine was soaked for about 10 minutes with Formula No. 61. The vehicle powered by the engine had an odometer mileage of around 83,000 miles. FIG. 11 shows the electrical response after cleaning this engine. Comparison of FIGS. 10 and 11 will show that the cleaning resulted in a significant improvement in the electrical response of the oxygen sensor.

Table IV below shows the cylinder power balance on the six-cylinder, 4.9-liter electronic fuel injection engine of FIG. 10 before cleaning with Formula No. 61. Table V below shows the test results after cleaning.

A fuel-metering pulse width from the electronic fuel injector for the engine before cleaning was measured and found to stay open for approximately 7.18 milliseconds. The fuel on this same six cylinder engine was flowing through all injectors for approximately 7.18 milliseconds per each opening. The number of openings per minute stays constant. The engine idling speed 15 for this recording was about 709 rpm. After cleaning, measurement showed the fuel-metering pulse width to be approximately 6.27 milliseconds per opening. The engine-control computer adjusted the air/fuel ratios and restricted the fuel-metering pulse width by approximately 12 percent because of the higher fuel flow rate after cleaning. The engine idling speed for the measurement after cleaning was approximately 725 RPM.

Table VI shows electrical data for the six cylinder engine. The wide spread of the kV firing voltage before cleaning indicates dirty spark plugs. Table VII shows the engine electrical data after cleaning. The lower kV and more consistent firing voltage between spark plugs range indicates cleaner spark plugs.

Table VIII shows the kV duration before cleaning. Note the duration range is lower and the duration spread between the spark plugs is greater. A longer spark duration range gives a more complete air/fuel cylinder burn, maximum power and minimum harmful emissions. The duration consistency of kV between cylinders contributes to a more equal power balance between cylinders and smoother engine running.

Table IX shows the desired kV duration is over 6 percent longer after cleaning and the kV range between cylinders is tighter.

Figure 9:
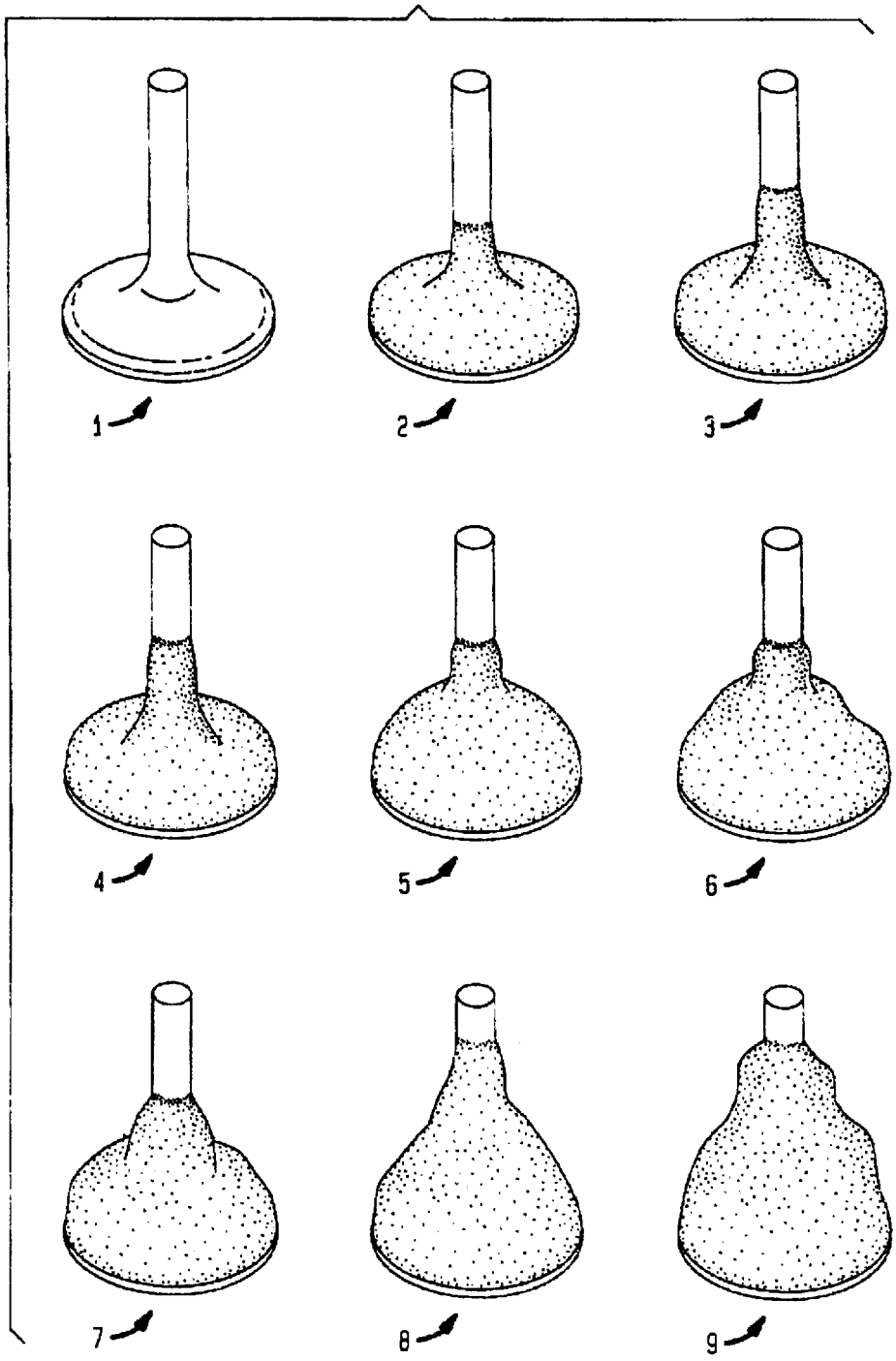
FIG. 9 is an illustration of lower portions of nine automobile exhaust valves soiled to varying degrees with carbonaceous deposits.

The engines were retested after driving approximately 300 miles with a recommended gasoline additive. Only minor improvements were observed on all electronic tests. Cylinder compression improved, cold engine starts improved and cold engine driveability improved. The most notable improvements were observed on removal of carbonaceous deposits on intake valves. The two gasoline additives, 2-furfurylamine and "Paradyne 741", were tested for carbonaceous deposit removal from intake valves without the synergistic engine cleaner soaking technique. The average removal after driving 300 miles was 200 to 500 mg. See FIG. 9 for baroscope carbonaceous deposit rating on intake valves.

Value class No. 1 is ~0.2 gms of deposits

Value class No. 2 is ~0.5 gms of deposits

Value class No. 3 is ~1.0 gms of deposits

Value class No. 4 is ~2.0 gms. of deposits

Value class No. 5 is ~4–5 gms of deposits

Value class No. 6 is ~6–7 gms of deposits

Value class No. 7 is ~8–10 gms of deposits

Value class No. 8 is ~11–13 gms. of deposits

Value class No. 9 is ~14 gms. of deposits

The average deposit removal from intake valves for approximately 10 minutes soaking with the preferred synergistic formulas of the invention can be from about 3 to about 4 grams. The average deposit removal for approximately 20 minutes soaking can be from about 4 to about 5 grams. Tests also show that after driving 300 miles using either gasoline additive after soaking, the deposit removal quantity can be roughly equal to the removal obtained during the soak. This example represents the general boroscope observation. A boroscope rating of No. 6 before soaking a fully warmed up engine generally shows the same intake value to be a rating of No. 4 after the 20 minute approximately soak cleaning procedure, and a rating of No. 1 after driving approximately 300 miles with the gasoline additive. A boroscope rating of No. 7 before soaking can show the same intake value to be a No. 5 rating after the approximately 20 minute soak cleaning procedure, and a No. 2 to 3 rating after then driving about 300 miles with the gasoline additive. A horoscope rating of a No. 7 before soaking generally can measure about 10 mm thick carbonaceous deposit. A preferred synergistic engine cleaner composition of the invention can soak into the porous coke deposit to around 10 mm depth in about 20 minutes at an engine back soak temperature of from about 250° F. to about 300° F. Approximately 2 mm of the coke can be dissolved in the approximately 20 minute soak cycle. Approximately another 3 mm can become very soft and wash off during the approximately two minute engine running cycle at the end of the approximately 20 minute soak period. Another approximately 4 to 5 mm of deposit can gradually be removed during the next approximately 300 mile driving with the gasoline additive. However, the approximately 5 mm of coke deposits left after the cleaning cycle can gradually harden and remain on the intake valve if the proper gasoline additive is not used.

TABLE IV

SHORTING POWER BALANCE BEFORE CLEANING

| CYL | RPM CHANGE | HC CHANGE |
|---|---|---|
| 1 | −16 | 230 |
| 5 | −20 | 20+ |
| 3 | −28 | 300 |
| 6 | −40 | 120 |
| 2 | −5 | 340 |
| 4 | −43 | 680 |
| MIN | −14 | 170 |
| MAD | −63 | 880 |
| BASE | 610 | 0 |

TABLE V

SHORTING POWER BALANCE AFTER CLEANING

| CYL | RPM CHANGE | HC CHANGE |
|---|---|---|
| 1 | 3 | 1960 |
| 5 | −26 | 2030 |
| 3 | −4 | 1990 |
| 6 | −3 | 2080 |
| 2 | −7 | 2070 |
| 4 | −24 | 2110 |
| MIN | −1 | 1440 |
| MAD | −46 | 2310 |
| BASE | 710 | 199 |

TABLE VI

ENGINE DATA BEFORE CLEANING

IDLE TEST

| | MIN | RESULTS | MAX |
|---|---|---|---|
| RPM | 650 | 709 | 750 |
| DWELL DEG | 9.00 | 23.3 | 39.6 |
| VOLTS | 13.6 | 13.9 | 14.6 |
| AMPS | 1 | **** | 25 |
| RIPPLE | 0.00 | 0.00 | 0.12 |
| COIL | 0.10 | 0.82 | 1.50 |
| VAC $H_2O$ | 197.1 | 275.6 | 339.9 |
| TEMP °F. | 145 | 202 | 239 |
| HC | 0 | 0 | 300 |
| CO | 0.00 | 0.15 | 3.00 |
| $O^2$ | 0.00 | 0.00 | 2.50 |
| $CO^2$ | 10.0 | 7.05 | — |
| A/F RATIO | — | 14.6 | — |
| LAMBDA | — | 0.983 | — |

| RPM 833 CYL | PEAK RPM LOW | 3341 RESULTS | COIL OSC 3 HIGH |
|---|---|---|---|
| kV FIRING | | | |
| 1 | 8.6 | 9.8 | 12.0 |
| 5 | 6.4 | 7.5 | 8.7 |
| 3 | 8.0 | 9.3 | 10.9 |
| 6 | 5.6 | 8.8 | 10.7 |
| 2 | 6.1 | 9.8 | 11.1 |
| 4 | 6.4 | 8.3 | 9.1 |
| MIN LIMIT | 7.8 | MAX LIMIT | 10.8 |
| kV SPARK | | | |
| 1 | 1.32 | 1.38 | 1.49 |
| 5 | 1.34 | 1.49 | 1.64 |
| 3 | 1.22 | 1.33 | 1.49 |
| 6 | 1.27 | 1.46 | 1.59 |
| 2 | 1.37 | 1.49 | 1.66 |
| 4 | 1.44 | 1.56 | 1.79 |
| MIN LIMIT | 1.25 | MAX LIMIT | 1.77 |

TABLE VII

ENGINE DATA AFTER CLEANING

IDLE TEST

| | MIN | RESULTS | MAX |
|---|---|---|---|
| RPM | 650 | 725 | 750 |
| DWELL DEG | 9.00 | 23.4 | 39.6 |
| VOLTS | 13.6 | 13.8 | 14.6 |
| AMPS | 1 | 0 | 25 |
| RIPPLE | 0.00 | 0.00 | 0.12 |
| COIL | 0.10 | 0.80 | 1.50 |

TABLE VII-continued

| ENGINE DATA AFTER CLEANING | | | |
|---|---|---|---|
| VAC "$H_2O$ | 197.1 | 278.4 | 339.9 |
| TEMP °F. | 145 | 197 | 239 |
| HC | 0 | 0 | 300 |
| CO | 0.00 | 0.19 | 3.00 |
| $O^2$ | 0.00 | 0.39 | 2.50 |
| $CO^2$ | 10.0 | 6.79 | — |
| A/F RATIO | — | 15.1 | — |
| LAMBDA | — | 1.018 | — |
| RPM 951 CYL | PEAK RPM LOW | 3567 RESULTS | COIL OSC 3 HIGH |
| | | kV FIRING | |
| 1 | 5.2 | 5.8 | 6.6 |
| 5 | 4.8 | 5.8 | 6.4 |
| 3 | 4.9 | 5.7 | 6.5 |
| 6 | 4.7 | 5.9 | 7.0 |
| 2 | 5.5 | 6.3 | 7.0 |
| 4 | 6.0 | 6.8 | 7.6 |
| MIN LIMIT | 5.0 | MAX LIMIT | 8.0 |
| | | kV SPARK | |
| 1 | 1.37 | 1.43 | 1.56 |
| 5 | 1.34 | 1.51 | 1.71 |
| 3 | 1.27 | 1.45 | 1.61 |
| 6 | 1.39 | 1.49 | 1.59 |
| 2 | 1.37 | 1.47 | 1.61 |
| 4 | 1.37 | 1.49 | 1.54 |
| MIN LIMIT | 1.26 | MAX LIMIT | 1.76 |

It is not intended to limit the present invention to the specific embodiments and formulations described above. It is recognized that changes may be made in the formulations, steps and embodiments described herein without departing from the scope and teachings of the instant invention, and it is intended to encompass all other embodiments, alternatives and modifications consistent with the subject invention.

What is claimed is:

1. An engine cleaner composition comprising (a) a heterocyclic ring compound having a boiling point of about 250° F. or greater;

(b) wherein said the heterocyclic ring compound is selected from the group consisting of:

2-methyl-1,5-Bis(2-oxopyrrolidin-1-yl)pentane,
N-cyclohexyl-2-pyrrolidone,
2-furfurylamine,
N-methyl-2-pyrrolidone, and
2-pyrrolidone; and (c) a blend of X weight percent water and (100-X) weight percent acetonitrile, where X is in the range of from about 5 to about 25 weight percent based on the combined weight of the water and the acetonitrile.

2. The engine cleaner composition according to claim 1 further comprising a second heterocyclic ring compound, the second heterocyclic ring compound having a boiling point of about 500° F. or greater.

3. The engine cleaner composition according to claim 2 in which X is in the range of from about 10 to about 20 weight percent based on the combined weight of the water and the acetonitrile.

4. The engine cleaner composition according to claim 3 in which the blend of water and acetonitrile are substantially in the proportions of a water/acetonitrile azeotrope.

5. An engine cleaner apparatus attachable to an air-intake system of an internal combustion engine for introducing an engine cleaner composition into an air-intake plenum of the air-intake system in the form of an aerosol fog, the engine cleaner apparatus comprising:

(a) a pressure-resistant container having a discharge outlet, the container being charged with an engine cleaner composition;

(b) a manually-actuatable valve connected to the discharge outlet of the pressure-resistant container;

(c) a flexhose having an inlet end and an outlet end with a flexhose bore extending through the flexhose from the inlet end to the outlet end, the inlet end being connected to the manually-actuatable valve for receiving engine cleaner composition discharged from the pressure-resistant container upon actuation of the valve; and (d) an air-intake-system adapter fitting connected to the outlet end of the flexhose, the adapter fitting being shaped and dimensioned to be connected to an air-intake-system element to provide communication between the bore of the flexhose and the air-intake plenum of the air intake system for introducing an aerosol fog of engine cleaner into the air-intake plenum; and (e) wherein the engine cleaner composition comprises:

(i) a heterocyclic ring compound having a boiling point of about 250° F. or greater, (ii) a blend of X weight percent water and (100-X) weight percent acetonitrile, where X is in the range of from about 5 to about 25 weight percent based on the combined weight of the water and the acetonitrile, and (iii) an aerosol propellant.

6. The engine-cleaner composition according to claim 2 further comprising a surfactant other than the hetrocyclic ring compounds.

7. The engine-cleaner composition according to claim 6 in which the surfactant is selected from the group consisting of isopropylamine dodecylbenzene sulfonate and polyoxylated alkyl phosphate ester.

8. The engine-cleaner composition according to claim 1 further comprising an aerosol propellant.

9. The engine cleaning composition of claim 8 wherein the aerosol propellant is present in an amount greater than 50%, by volume and has a boiling point less than 32° F.

10. The engine cleaning composition of claim 9 wherein the aerosol propellant is present in an amount of more than 70%, by volume.

11. The engine cleaner composition according to claim 8 in which the aerosol propellant is a fluorohydrocarbon.

12. An engine cleaner composition comprising:

(a) three heterocyclic ring compounds, a first and a second of the three heterocyclic ring compounds having a boiling point of about 400° F. or greater and a third of the heterocyclic ring compounds having a boiling point in the range of from about 250° F. to about 400° F.;

(b) wherein said first, second and third of the heterocyclic ring compounds are selected from the group consisting of:

2-methyl-1,5-Bis(2-oxopyrrolidin-1-yl)pentane,
N-cyclohexyl-2-pyrrolidone,
2-furfurylamine,
N-methyl-2-pyrrolidone, and
2-pyrrolidone and;

(c) a blend of X weight percent water and (100-X) weight percent acetonitrile, where X is in the range of from about 5 to about 25 weight percent based on the combined weight of the water and the acetonitrile.

13. The engine cleaner composition according to claim 12 in which X is in the range of from about 10 to about 20 weight percent based on the combined weight of the water and the acetonitrile.

14. The engine cleaner composition according to claim 13 in which the blend of water and acetonitrile are substantially in the proportions of 84 wt % acetonitrile and 16 wt % water.

15. The engine cleaner apparatus according to claim 5 in which the air-intake-system adapter fitting includes a coupler adapter and a swirl-chamber cap insert, the coupler adapter having a bore extending generally axially through the adapter, an outlet end of the bore being shaped and dimensioned to receive and retain the swirl-chamber cap, the swirl-chamber cap being shaped to define a swirl chamber within an interior of the cap, interior surfaces of the swirl-chamber cap facing the swirl chamber having swirl-flow-inducing elements formed therein, an outlet orifice passing through the swirl-chamber cap to permit fluid to flow out of the swirl chamber through the orifice, the swirl-flow-inducing elements formed in the interior surfaces of the swirl-chamber cap being effective to induce a swirling flow of fluid passing through the swirl chamber, the coupler adapter and swirl chamber cap being effective to tend to form a full mechanical break up spray in operation when an engine-cleaner composition is passed through the bore.

16. The engine-cleaner composition according to claim 12 further comprising a surfactant.

17. The engine-cleaner composition according to claim 16 in which the surfactant is selected from the group consisting of isopropylamine dodecylbenzene sulfonate and polyoxy-alkylated alkyl phosphate ester.

18. The engine-cleaner composition according to claim 12 further comprising an aerosol propellant.

19. The engine cleaner composition according to claim 18 in which the aerosol propellant is selected from the group consisting of propane, isobutane, normal butane, fluorohydrocarbon "134-a" and an aerosol grade hydrocarbon blend designated in the trade "A-46" or "A-60", fluorocarbon "152a", dimethyl ether and mixtures thereof.

20. An engine-cleaner method for cleaning carbonaceous-deposits from internal surfaces of an internal combustion engine comprising the steps of:

(a) generating an aerosol fog of an engine-cleaner composition comprised of:

(i) a heterocyclic ring compound having a boiling point of about 250° F. or greater; and (ii) a blend of X weight percent water and (100-X) weight percent acetonitrile, where X is in the range of from about 5 to about 25 weight percent based on the combined weight of the water and the acetonitrile;

(b) introducing a quantity of the aerosol fog into an air-intake manifold of the engine;

(c) allowing the engine-cleaner composition to interact with carbonaceous-deposit material on internal surfaces of the engine with the engine off for an engine-cleaner-soak time sufficient to permit a portion of the engine-cleaner composition to soak into and loosen, soften or dissolve carbonaceous-deposit material on the internal surface; and (d) running the engine for a time to remove carbonaceous-deposit material, loosened, softened or dissolved by the engine cleaner from internal surfaces of the engine.

21. The engine cleaner method according to claim 20 further comprising the step of: prior to the step (b) of introducing the quantity of aerosol fog of engine-cleaner composition into the air-intake manifold of the engine, running the engine for a time sufficient to warm up the engine.

22. The engine cleaner method according to claim 21 further comprising the step of adding a quantity of a surfactant fuel additive to the fuel of the engine.

23. The engine cleaner apparatus according to claim 15 in which the air-intake-system adapter fitting further includes a Maltese-Cross insert positioned within the bore of the coupler adapter upstream of the swirl-chamber cap.

24. The engine cleaner method according to claim 20 in which the blend of water and acetonitrile of the engine cleaner composition are substantially in the proportions of a water/acetonitrile azeotrope.

25. The engine cleaner method according to claim 24 in which the engine cleaner composition comprises three heterocyclic ring compounds, a first and a second of the three heterocyclic ring compounds having a boiling point of about 400° F. or greater and a third of the heterocyclic ring compounds having a boiling point in the range of from about 250° F. to about 400° F.

26. The engine cleaner method according to claim 25 in which each of the first, the second and the third of the heterocyclic ring compounds of the composition are selected from the group consisting of:

2-methyl-1,5-Bis(2-oxopyrrolidin-1-yl)pentane,

N-cyclohexyl-2-pyrrolidone, 2-furfurylamine,

N-methyl-2-pyrrolidone, and 2-pyrrolidone.

27. The engine cleaner method according to claim 26 in which the engine cleaner composition further comprises a surfactant.

28. The engine cleaner apparatus of claim 5 in which the engine cleaner composition comprises:

(i) three heterocyclic ring compounds, a first and a second of the three heterocyclic ring compounds having a boiling point of about 400° F. or greater and a third of the heterocyclic ring compounds having a boiling point in the range of from about 250° F. to about 400° F.;

(ii) a blend of X weight percent water and (100-X) weight percent acetonitrile, where X is in the range of from about 5 to about 25 weight percent based on the combined weight of the water and the acetonitrile, and (iii) an aerosol propellant.

29. The air cleaner apparatus of claim 5 in which the air-intake-system adapter fitting includes a coupler flexhose and a male/male coupler adapter, said coupler adapter being shaped and dimensioned to be connected to an outlet end of the flexhose, said coupler flexhose being connectable at one end to an end of the coupler adapter, the coupler flexhose also being connectable at an opposing end to an air-intake-system porta-fitting element of the engine providing communication with the air-intake plenum.

30. The engine cleaner apparatus of claim 29 in which the air-intake-system adapter fitting includes a male/plural-diameter male coupler adapter having a bore extending generally axially therethrough from an inlet end to an outlet end, an outlet side of the adapter being shaped to form a series of generally cylindrical outlet-side coupler elements of differing outside diameters, the outside diameters of the outlet-side coupler elements decreasing in a step-wise fashion along the adapter in a direction advancing from the inlet end towards the outlet end.

31. The engine cleaner apparatus of claim 30 wherein the male/plural-diameter male coupler adapter includes outlet-side coupler elements dimensioned to fit within and retain flex hoses of three different inside diameters, a smaller outlet-side coupler element dimensioned for a 3/16" inside diameter hose, an intermediate outlet-side coupler element being dimensioned for a 3/8" inside diameter hose and a larger outlet-side coupler element being dimensioned for a 1/2" inside diameter hose.

32. The engine cleaner apparatus of claim 30 in which each coupler element has barbed outer surface portions for retaining a hose fitted around the coupler element.

33. The engine cleaner apparatus according to claim 5 in which the air-intake-system adapter fitting includes a coupler adapter having a bore extending generally axially through the adapter, the bore having a substantially uniform inside diameter along the length of the bore, the diameter of the bore of the coupler adapter being effective to tend to form a nonmechanical break-up spray in operation when an engine-cleaner composition including an aerosol propellant is passed through the bore.

34. The engine cleaner apparatus according to claim 33 in which the diameter of the bore of the coupler adapter is about 0.1 inch (2.5 mm).

35. The engine cleaner apparatus according to claim 5 in which the air-intake-system adapter fitting includes a coupler adapter having a bore extending generally through the adapter, the bore having constriction in diameter in an axial location proximate to an outlet end of the bore, the constriction being effective to tend to form a semi-mechanical break-up spray in operation when an engine-cleaner composition including an aerosol propellant is passed through the bore.

36. The engine cleaner apparatus according to claim 34 in which each of the first, the second and the third of the heterocyclic ring compounds of the composition are selected from the group consisting of:

2-methyl-1,5-Bis(2-oxopyrrolidin-1-yl)pentane,

N-cyclohexyl-2-pyrrolidone, 2-furfurylamine,

N-methyl-2-pyrrolidone, and 2-pyrrolidone.

37. The engine-cleaner apparatus according to claim 36 in which the engine cleaner composition further comprises a surfactant.

* * * * *